US011346217B2

(12) United States Patent
Rowe

(10) Patent No.: US 11,346,217 B2
(45) Date of Patent: May 31, 2022

(54) PLASMA OPTIMIZATION WITH FORMATIONAL AND FLUID INFORMATION

(71) Applicant: Halliburton Energy Services, Inc., Houston, TX (US)

(72) Inventor: Mathew Dennis Rowe, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 17/008,176

(22) Filed: Aug. 31, 2020

(65) Prior Publication Data

US 2022/0065106 A1 Mar. 3, 2022

(51) Int. Cl.

| | |
|---|---|
| ***E21B 49/08*** | (2006.01) |
| ***E21B 7/15*** | (2006.01) |
| ***E21B 44/00*** | (2006.01) |
| ***E21B 49/00*** | (2006.01) |

(52) U.S. Cl.

CPC ..... *E21B 49/086* (2013.01); *E21B 7/15* (2013.01); *E21B 44/00* (2013.01); *E21B 49/003* (2013.01)

(58) Field of Classification Search

CPC ..... E21B 7/15; E21B 44/00; E21B 49/003; E21B 49/086

See application file for complete search history.

(56) References Cited

U.S. PATENT DOCUMENTS

| | | | | |
|---|---|---|---|---|
| 1,720,325 | A * | 7/1929 | Hackstaff | G01V 3/20 436/28 |
| 2,700,897 | A * | 2/1955 | Arps | G01V 3/22 175/42 |
| 4,741,405 | A * | 5/1988 | Moeny | E21B 7/007 175/16 |
| 7,529,626 | B1 * | 5/2009 | Ellis | G01N 33/2823 702/9 |
| 8,230,916 | B2 * | 7/2012 | Sumrall | E21B 49/10 73/152.55 |
| 9,181,754 | B2 * | 11/2015 | Donderici | E21B 7/00 |
| 10,113,364 | B2 * | 10/2018 | Moeny | H01F 38/08 |
| 10,400,596 | B2 * | 9/2019 | Lawson | E21B 49/088 |
| 10,407,995 | B2 * | 9/2019 | Moeny | E21B 7/15 |
| 10,641,073 | B2 * | 5/2020 | Curlett | E21B 43/2401 |
| 10,641,757 | B2 * | 5/2020 | Rowe | G01N 33/241 |

(Continued)

*Primary Examiner* — Jennifer H Gay

(74) *Attorney, Agent, or Firm* — Benjamin Ford; C. Tumey Law Group PLLC

(57) ABSTRACT

A method for drilling may comprise disposing a bottom hole assembly into a first wellbore. The bottom hole assembly may include a pulse power drilling assembly having one or more electrodes disposed on a drill bit and a pulse-generating circuit. The method may further include activating the one or more electrodes by applying an amperage, a voltage, and a cycle rate to the one or more electrodes to form an arc and a spark, adjusting the arc and the spark based at least in part on a hydrodynamic energy balance and a thermal energy balance, identifying one or more chemical reaction products created from an interaction of the arc and the spark with a formation, and adjusting the amperage, the voltage, and the cycle rate based on the chemical reaction products and storing the adjusted amperage, voltage, and cycle rate.

20 Claims, 8 Drawing Sheets

(56) References Cited

U.S. PATENT DOCUMENTS

| | | | | |
|---|---|---|---|---|
| 2009/0126928 | A1* | 5/2009 | Sumrall | G01N 33/2823 166/250.01 |
| 2013/0032400 | A1* | 2/2013 | Dirksen | E21B 10/18 175/17 |
| 2013/0032404 | A1* | 2/2013 | Donderici | E21B 47/113 175/45 |
| 2015/0083491 | A1* | 3/2015 | Moeny | E21B 7/15 307/112 |
| 2015/0198038 | A1* | 7/2015 | Bartetzko | C09K 8/60 166/250.05 |
| 2016/0003793 | A1* | 1/2016 | Rowe | E21B 49/08 702/11 |
| 2016/0017663 | A1* | 1/2016 | Moeny | E21B 17/003 175/327 |
| 2016/0115786 | A1* | 4/2016 | Breviere | G01N 33/2823 73/152.23 |
| 2018/0148981 | A1* | 5/2018 | Moeny | E21B 17/003 |
| 2018/0156034 | A1 | 6/2018 | Mitchell et al. | |
| 2019/0368345 | A1* | 12/2019 | Rowe | G01N 33/2823 |
| 2020/0256188 | A1 | 8/2020 | Rowe | |
| 2022/0065044 | A1* | 3/2022 | Rowe | E21B 44/00 |
| 2022/0065102 | A1* | 3/2022 | Rowe | E21B 49/08 |
| 2022/0065103 | A1* | 3/2022 | Rowe | G01N 33/2823 |
| 2022/0065105 | A1* | 3/2022 | Rowe | E21B 7/15 |
| 2022/0065106 | A1* | 3/2022 | Rowe | E21B 21/067 |
| 2022/0065107 | A1* | 3/2022 | Rowe | E21B 49/008 |
| 2022/0065769 | A1* | 3/2022 | Rowe | E21B 7/15 |

* cited by examiner

PLASMA OPTIMIZATION WITH FORMATIONAL AND FLUID INFORMATION

Mud logging during drilling of a wellbore may provide information about geological formations and fluid. Such information may be correlated to petrophysical properties and depths within the formation during wellbore drilling based on testing and measurement of drilling mud returned to the surface. Drilling mud (also referred to as mud) is the fluid that may be pumped down the drill string in order to lubricate the bottom hole assembly and drill string, to suppress fluid or gas ingress into the bore hole and maintain pore pressure, and also to remove cuttings from the well as it circulates to the surface.

When wellbores are drilled in a geological formation, information about the formation layers and fluids—such as lithology, porosity, permeability, petrochemical type, petrochemical concentration, etc.—can be determined based on the chemical composition of the mud, cuttings, and dissolved gasses returned to the surface. In traditional mud logging, a record of the characteristics determined from the drilling mud may be kept as a function of drilling depth in order to correlate rock, fluid, and gas characteristics to layers and reservoirs at depths in the formation.

BRIEF DESCRIPTION OF THE DRAWINGS

These drawings illustrate certain aspects of the present disclosure and should not be used to limit or define the disclosure.

DETAILED DESCRIPTION

Conventional wellbore drilling includes rotary drilling using a drill bit having cutting elements that are rotated to cause a cutting (fracturing or crushing) of the rock. In contrast, pulse power drilling drills the wellbore using electric pulses that include short duration, periodic, high-voltage pulses that are discharged through the rock in the surrounding formation. Such discharges may create high internal pressure to break or fracture the rock from the inside (breaking from tension).

Such pulse power drilling may create a plasma, a high energy fluid, in the drilling fluid or rock downhole which functions as a high-energy discharge. Plasma, which is the fourth state of matter, may be a highly conductive, ionized gas containing free electrons and positive ions (from which the electrons have been disassociated). In the high temperature and high-pressure environment downhole, the creation of a plasma involves injecting large amounts of energy into the subsurface formation. Ideally, the energy would be injected entirely into the subsurface formation as mechanical crushing force. However, a portion of the energy may also be absorbed by the drilling fluid. This situation may arise when the drill string is not in contact with a bottom of the borehole when the energy is discharged from the electrodes of the drill string due to borehole irregularities, or due to bottom hole assembly geometry.

In response to the energy being injected into the subsurface formation, ionic bonds within the rock of the formation may be broken and formation fluid vaporized. The energy output from the electrodes of the drill string may also create chemical reactions between the species downhole. These chemical reactions may generate chemically complex molecules which should be accounted for in mud logging because these complex molecules are not constituents of either the formation fluid or the drilling mud. By correlating the concentration of chemical species and cuttings returned to the surface to plasma generation parameters, formation evaluation, and mud logging may be more accurate. Additionally, this chemical analysis for a current and/or previous well may be used to modify or update drilling operations for the current well.

Figure 1:
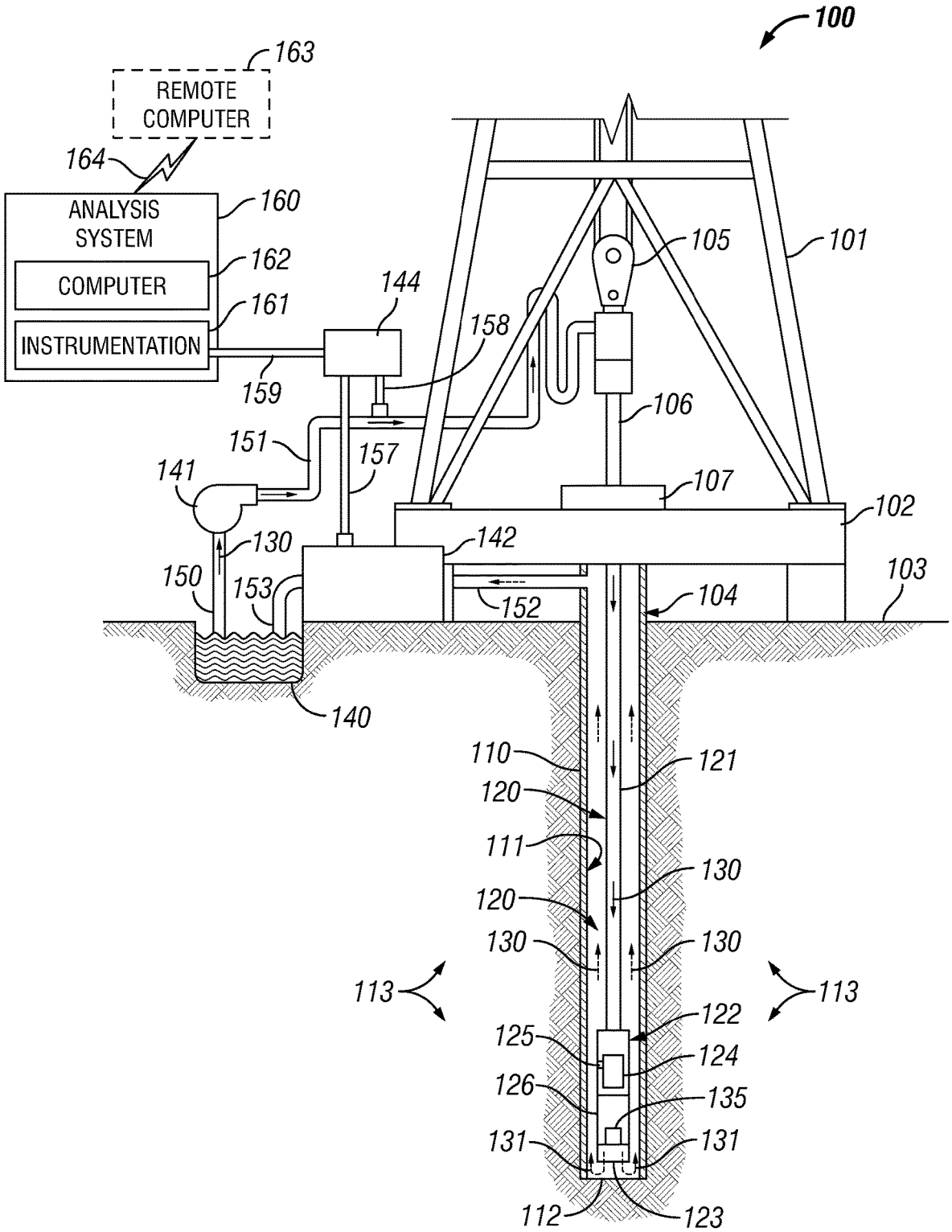
FIG. 1 depicts an example pulse power drilling system for mud logging, according to one or more embodiments.

FIG. 1 illustrates a schematic diagram of a pulse power drilling system (a system 100), according to one or more embodiments. The system 100 as illustrated in FIG. 1 includes a derrick 101 positioned on a platform 102 that is located above a surface 103 and covering a wellhead 104. The wellhead 104 includes a borehole 110 that extends from the surface 103 into one or more layers of a subterranean formation 113. The borehole 110 may include borehole walls 111 that extend substantially vertically from surface 103 and parallel to one another, forming, and at least partially enclosing, the space within the borehole that extends from surface 103 to a borehole bottom surface 112. Although shown as having a substantially vertical orientation in FIG. 1, embodiments of the borehole 110 are not limited to vertically orientated boreholes, and may include at least some portion(s) of the borehole that extend at an angle relative to vertical, including in some embodiments portions of the borehole that may extend horizontally in a direction parallel to the surface 103.

The system 100 includes a drill string 120 that may be positioned over and extending downward into the borehole 110. The drill string 120 may be supported at an upper portion by a hoist 105 suspended from derrick 101 that allows the drill string 120 to be controllable lowered into and raised to different depths within the borehole 110, and/or inserted into and completely withdrawn from the borehole 110. The drill string 120 may be coupled to a hoist 105 through a kelly 106 and may extend through a rotary table 107 positioned adjacent to and/or extending through an opening in a platform 102. The rotary table 107 may be configured to maintain the position of the drill string 120 relative to the platform 102 as the drill string 120 is extended through the opening in the platform 102 and into the borehole 110. The drill string 120 may comprise a plurality of sections of drill pipe 120 coupling a lower or distal end of the drill string 120 to a bottom hole assembly (BHA) 122.

The BHA 122 includes a pulse power drilling (PPD) assembly 126 having electrodes of the drill bit 123 and a pulse-generating circuit 135.

Referring again to FIG. 1, a drilling fluid 130, such as drilling mud, may be initially sourced from a fluid pit 140, which may be referred to as a "mud pit." Although, depicted below the surface 103, the mud pit may be equipment located on the surface 103 as well. A pump 141 may be used to suction the drilling fluid 130 from the fluid pit 140 through a fluid conduit 150, and provide a pressurized flow or circulation of the drilling fluid 130 through a fluid conduit 151 to the upper portion of the drill string 120, as illustratively represented by the solid line arrows included within the fluid conduits 150 and 151. The drilling fluid 130 may then proceed through the sections of the drill pipe 120 that make up portions of the drill string 120, providing a fluid passageway for the drilling fluid 130 to flow from the upper portion of the drill string 120 to the BHA 122 positioned within the drill string 120.

The flow of the drilling fluid 130 is directed through the BHA 122 and expelled from one or more ports included in the electrodes of the drill bit 123. The drilling fluid 130, as illustratively represented in FIG. 1 by dashed-line arrows, that has been expelled from ports on, or through, the electrodes of the drill bit 123 helps to remove formation material that has been broken up by the electrical energy generated at the electrodes of the drill bit 123 in a direction away from the electrodes of the drill bit 123 and away from a borehole bottom surface 112.

In addition to carrying away broken up formation material, the flow of a drilling fluid 130 may also represent drilling fluid that has been exposed to or that has otherwise interacted with the electrical energy being applied by the electrodes of the drill bit 123 to the borehole bottom surface 112 and/or to the drilling fluid in the vicinity of the electrodes of the drill bit 123. The drilling fluid 130 is illustrated as broken-line arrows to represent drilling fluid that may have one or more chemical properties and/or one or more physical properties of the drilling fluid that have been altered due to the interaction of the drilling fluid 130 with the electric energy provided by the electrodes of the drill bit 123. The flow of the drilling fluid 130 continues to flow back upward toward the surface 103 through the annulus 114 of the borehole 110. The annulus 114 is formed by the space between the borehole walls 111 and the outer surfaces of the drill string 120. The drilling fluid 130 flowing into the drill string 120 from the mud pit may be referred to as "influent," and the drilling fluid 130 flowing from the electrodes of the drill bit 123 back the fluid pit 140. In one or more embodiments, this drilling fluid 130, the influent or inward flow, and the drilling fluid 130, the effluent or upward/outward flow, are part of a continuous circulation of drilling fluid.

As the upward flow of the drilling fluid 130 reaches the surface 103, the flow may be directed into fluid conduit 152, which directs the flow of returning drilling fluid 130 to a fluid reconditioning system 142. The fluid recondition system 142 may comprise any number of devices, such as shakers, screens, and/or wash stations, which are configured to process the drilling fluid 130, for example, to remove and/or recover cuttings from the drilling fluid 130 being processed. In one or more embodiments, the fluid reconditioning system 142 may include one or more of desalters, de-sanders, and de-gassing apparatus. The fluid reconditioning system 142 may also process the drilling fluid 130 to refine or alter other properties of the drilling fluid 130, for example, to remove dissolved or suspended gasses present in the drilling fluid 130. The fluid reconditioning system 142 may also be configured to add chemicals, such as high dielectric constant muds or clays, conductive nanoparticle suspensions, weighting agents, etc., to the drilling fluid 130 to alter or reinforce various performance properties of the drilling fluid 130 before the drilling fluid 130 is ultimately returned/recirculated to the borehole 110. Upon completion of the processing of the drilling fluid 130 passing through the fluid reconditioning system 142, the drilling fluid 130 may be returned to the fluid pit 140 through a fluid conduit 153. The drilling fluid 130 returned to the fluid pit 140 may then become available for recirculation to the borehole 110 as described above.

An extraction system 144 is fluidly coupled to the circulation of the drilling fluid 130 via a fluid conduit 157 running from the fluid reconditioning system 142 to extract an effluent sample of the drilling fluid 130 that has exited the borehole 110 via the fluid conduit 152. The extraction system 144 is optionally also coupled to the fluid conduit 151 via the fluid conduit 158 to extract an influent sample of the drilling fluid 130 prior to its entering into the drill string 120.

In one or more embodiments, the extraction system 144 includes one or more gas extractors to extract a gas sample from the drilling fluid 130, one or more sampling apparatus to sample or extract the liquids portion of the fluid, or both. The extraction system 144 may sample gas or liquids directly from the fluid reconditioning system 142 or (although not shown) from another point in the flow of drilling fluid 130 from the borehole 110 or the flow of the drilling fluid 130 into the drill string 120.

In addition to the returning drilling fluid being directed to the fluid reconditioning system 142 as described above, in various embodiments of the system 100 a portion of the returning drilling fluid is directed to a sample analysis system (the analysis system 160). The extraction system 144 directs drilling fluid (e.g. effluent drilling fluid 130) extracted or sampled from the fluid recondition system 142 to the analysis system via fluid conduit 159. In one or more embodiments, the extraction system 144 extracts or samples influent drilling fluid 130, e.g., from fluid conduit 151 as shown or, although not shown, from one or more other points in the influent side of the system, e.g. from fluid conduit 150 or from the fluid pit 140.

The analysis system 160 may include an instrumentation 161 and an information handling system 162, which may be disposed at the surface. In examples, information handling system 162 may connect to sensors and other devices by a communication link (which may be wired or wireless, for example) which may transmit data to information handling system 162. Information handling system 162 may include a personal computer, a video display, a keyboard (i.e., other input devices.), and/or non-transitory computer-readable media (e.g., optical disks, magnetic disks) that may store code representative of the methods described herein. Likewise, information handling system 162 may process measurements taken by one or more sensors automatically. During operations, software, algorithms, and modeling may be performed by information handling system 162. Information handling system 162 may perform steps, run software, perform calculations, and/or the like automatically, through automation (such as through artificial intelligence ("AI"), dynamically, in real-time, and/or substantially in real-time.

The instrumentation 161 may comprise one or more devices configured to measure and/or analyze one or more chemical and/or physical properties of the drilling fluid provided to the analysis system 160. Illustrative and nonlimiting examples of the devices that may be included as part of the instrumentation 161 include one or more gas chromatograph (GC) (e.g., one or more of a gas chromatography—isotope ratio mass spectrometer (GC-IRMS), gas chromatography-infrared isotope ratio analyzer (GC-IR2), dual gas chromatograph with a flame ionization detector (FID), or the like) and one or more mass spectrometer (e.g., one or more of an isotope ratio mass spectrometer (IRMS), magnetic sector mass spectrometer, Time-of-Flight mass spectrometer (TOF-MS), triple quadrupole mass spectrometer (TQMS), tandem mass spectrometer (MS/MS), thermal ionization-mass spectrometer (TIMS), inductively coupled plasma-mass spectrometer (ICP-MS), Spark Source mass spectrometer (SSMS), or the like). In one or more embodiments, instrumentation 161 may further include one or more of a liquid chromatograph, a laser spectrometer, a multivariate optical computing device (e.g. one or more integrated optical element), a nuclear magnetic resonance (NMR) measurement device, a cavity ring-down spectrometer, an electromechanical gas detector, a catalytic gas detector, an infrared gas detector, a cutting analysis tool or system for further analysis of the gas, liquid, and/or solids. In one or more embodiment, the instrumentation 161 also may include one or more temperature sensors for measuring the temperature of the effluent and/or influent samples and may include one or more pressure sensors to measure the pressure of the effluent and/or influent samples. These sensors or others sensors may also be distributed at different points along the fluid circulation path, such as in the extraction system 144, the pump 141, the BHA 122, the drill string 120, the annulus 114, along any of the fluid conduits 150-159, and/or at another point in the fluid circulation path.

The instrumentation 161 may provide one or more measurements or determined outputs to the information handling system 162 that may be used as inputs for further analysis, learning, calculation, determination, display, or the like. The fluid samples received by, or continuous measurements obtained by, the analysis system 160, e.g. as inputs to the information handling system 162, may be correlated with time, depth, and/or other information related to the interaction of the fluid sample with electrical energy emanating from the electrodes of the drill bit 123. For example, a particular sample of drilling fluid may be correlated to a specific time and/or a depth where drilling fluid sample was when the fluid interacted with electrical energy emanating from the electrodes of the drill bit 123. In some embodiments, this correlation is based, at least in part, on the measured rates for flow of the drilling fluid down through the drill string 120 and back up through the annulus 114 over time to determine when the sample of drilling fluid being analyzed interacted with the electrical energy provided by the electrodes of the drill bit 123.

The information handling system 162, in some embodiments, is integral with one or more of the devices included the instrumentation 161, and/or may be separate computer device(s) that may be communicatively coupled to the devices included in the instrumentation 161. In other examples, the information handling system 162 may be computing devices, such as personal computers, laptop computers, smartphones, or other devices that allow a user, such as a field technician or an engineer, to enter, observe, and otherwise interact with various software applications providing data reports and control inputs for the measurements and analysis being performed on the drilling fluid by the analysis system 160.

In various embodiments, although not shown, the information handling system 162 may be communicatively linked with other devices, such as the BHA 122, the pump 141, the extraction system 144, and/or the fluid reconditioning system 142. The communication provided between the information handling system 162 and other devices within the system 100 may be configured to allow the information handling system 162 to adjust operating parameters, such as but not limited to adjusting the flow rates of drilling fluid provided to the drill string 120, control over the positioning of the drill string 120 with the borehole 110, and control over the operating parameters associated with the electrical generation and application of electrical power being performed by the bottom hole assembly 122. Communications from the information handling system 162 may also be used to gather information provided by the fluid reconditioning system 142, and/or to provide feedback to the fluid reconditioning system 142 to control the processes being performed on the returning drilling fluid by the fluid reconditioning system 142.

The analysis system 160 and the extraction system 144 (from the extracted samples from the influent and from the effluent) may output one more compositions of the drilling fluid, one or more compositions of the formation fluid, and/or one or more isotope ratio. For example, the extracted sample from the influent 130 may be used as a baseline to determine the contribution of the formation fluid and/or a downhole reaction at the drill bit to the composition of the effluent.

The analysis system 160 may determine various parameters related to the formation 113, and/or various parameters related to the operation of the pulse power drilling assembly, based on measurements and/or analysis performed to determine various chemical and/or physical properties present in the drilling fluid that has been exposed to or that has otherwise interacted/reacted with the electrical energy provided by the electrodes of the drill bit 123. Further, various operating parameters, such as electrical parameters, associated with the discharge of the electrical energy from the electrodes of the drill bit 123 within borehole 110, may be measured and analyzed to derive data and make determinations about various parameters associated with the formation 113, parameters associated with properties of the drilling fluid, parameters associated with the operating parameters of the BHA 122, and/or parameters associated with the operating parameters of the PPD assembly 126.

In various embodiments, the system 100 may include the analysis system 160 having a communication link, illustratively represented by a lightning bolt 164, configured to provide communications between the analysis system 160 and one or more remote computer systems 163. The remote computer systems 163 may be configured to provide any of the data functions associated with and/or the analysis function described above that may be associated with the drilling fluid as provided by the analysis system 160. In various embodiments, the remote computer systems 163 may including storage devices, such as data storage disks, configured to store the data being generated by the analysis being performed by the analysis system 160. In various embodiments, the remote computer system 163 may include display devices, such as computer monitors, that allow users at a remote location, i.e., locations away from the location where the system 100 is physically located, to visually see and interact with the visual representations of the data being provided by the analysis system 160. In various examples, control inputs, as described above, may be provided via user input provided to the remote computer systems 163 and communicated to the analysis system 160 for the purpose of controlling one or more of the operating parameters associated with system 100.

In some embodiments of the system 100, the BHA 122 includes a sampling tool 124. The sampling tool 124 may be located within the housing of the BHA 122. The sampling tool 124 may be coupled to the annulus 114 through the port 125, wherein the port 125 provides a fluid communication passageway between the annulus 114 and the sampling tool 124. In various embodiments, the port 125 may be used to collect a sample of drilling fluid, such as the drilling fluid 130 illustratively represented by dashed-line arrows. The sample of collected drilling fluid may be provided to the instrumentation 161, where one or more measurements and/or further analysis of the drilling fluid may be performed by the sampling tool. Measurements made, e.g., from one or more pressure or temperature sensors and/or a multivariate optical computing device, and/or data collected from the analysis of the samples of drilling fluid collected through the port 125 may be communicated through a communication link, e.g., via wired (like a wireline or wired pipe) or wireless telemetry (like mud pulse, acoustic, or electromagnetic telemetry) to the surface, and optionally to the analysis system 160. In the alternative or in parallel with the above, the sample of drilling fluid collected through the port 125 may be contained, for example bottled, and then transported back to the surface with the BHA 122. Any samples of drilling fluid collected via the port 125 may be data stamped with information indicating the time, depth, and/or other information associated with the collection of the fluid sample.

Figure 2A:
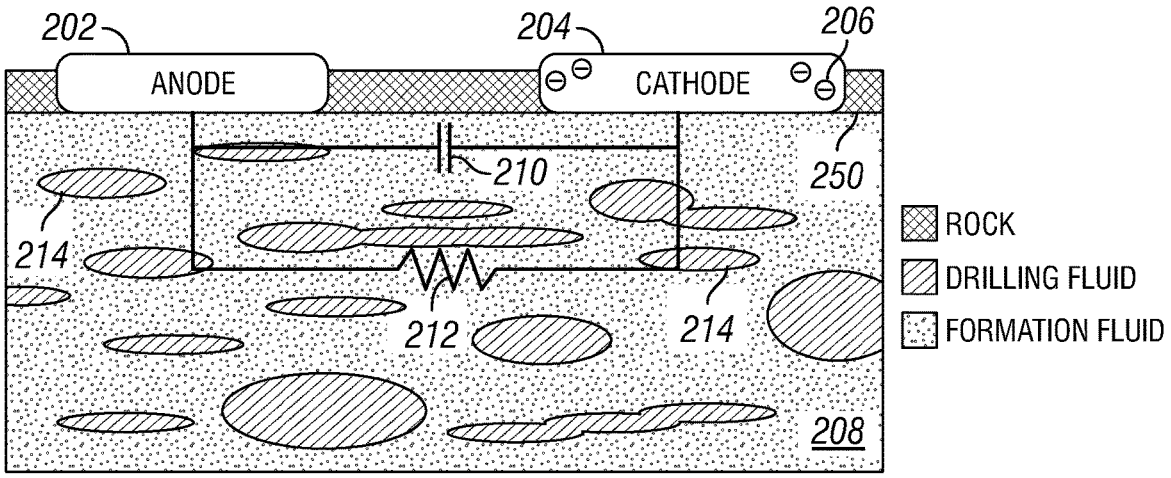
FIG. 2A depicts electrodes of a pulse power drill string at the bottom of a wellbore prior to emission of a pulse into the formation, according to one or more embodiments.
Figure 2B:
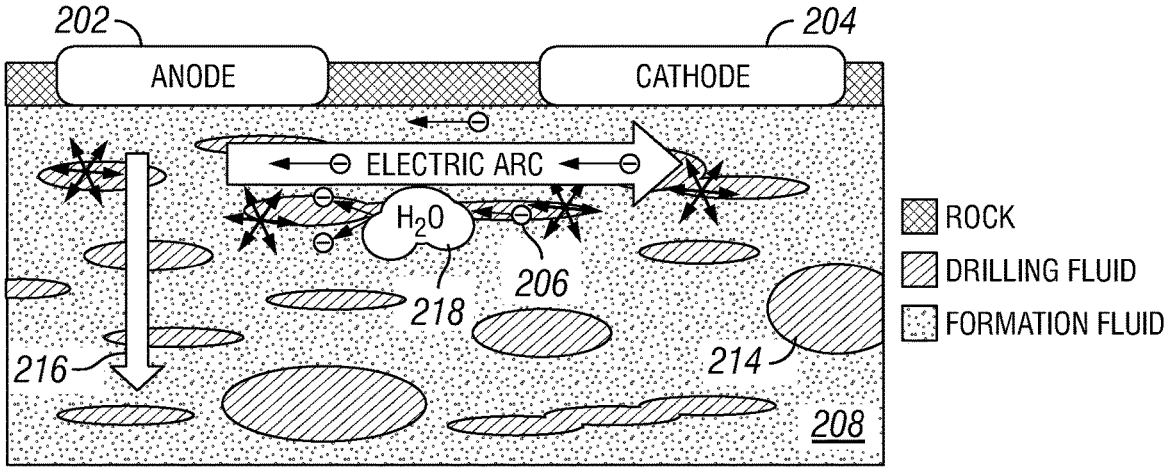
FIG. 2B depicts the electrodes of a pulse power drill string of FIG. 2A during emission of a pulse into the formation, according to one or more embodiments.
Figure 2C:
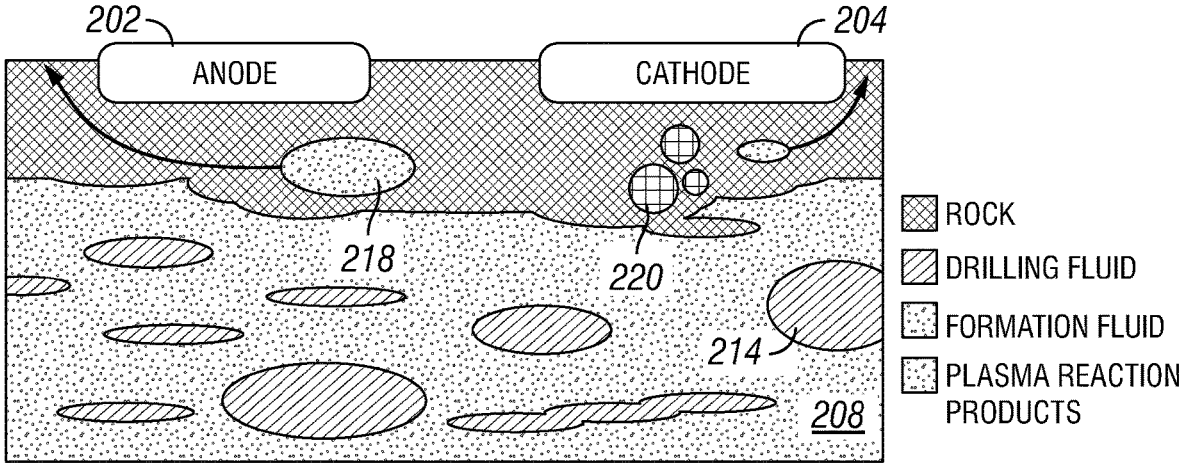
FIG. 2C depicts electrodes of a pulse power drill string at the bottom of a wellbore after emission of a pulse into the formation, according to one or more embodiments.

FIGS. 2A-2C depict electrodes of a pulse power drill string at the bottom of a wellbore at three different points in time relative to the emission of a pulse into the formation, according to one or more embodiments. FIG. 2A depicts electrodes of a pulse power drill string at the bottom of a wellbore prior to emission of a pulse into the formation, according to some embodiments. In this example, a drill bit includes electrodes depicted as an anode 202 and a cathode 204. The anode 202 and the cathode 204 may be examples of the electrodes within the drill bit 123 of the drill string 120 of FIG. 1.

In pulse power drilling, the anode 202 and the cathode 204 (when not performing off-bottom analysis) may rest along a bottom 250 of the wellbore in contact with a formation 208. The formation 208 includes a number of pore spaces 214 having formation fluid. One or more of the electrodes may be charged by portions of the drill string as described above. This charging may induce charge carriers at the electrode formation interface-either electrons or holes which are theoretical charge carriers representing the absence of electrons. For simplicity, only electrons 206 are shown.

The dielectric between the anode and cathode may be comprised of the formation rock or stone, the formation fluid in the pores of the rock strata, and the drilling fluid pumped downhole. The dielectric, before the plasma is applied, may be approximated as a resistor 212 in series with a capacitor 210, where the dielectric strength may be a function of porosity, permeability, formation type, formation fluid composition, and drilling fluid composition.

FIG. 2B depicts the electrodes of a pulse power drill string of FIG. 2A during emission of a pulse into the formation, according to some embodiments. As shown in FIG. 2B, a plasma discharge into the formation 208 may result in vaporization of the fluid in the pore spaces 214, which causes expansion of the liquid in the pores as it is converted to a high-pressure vapor or gas, and leads to destruction of the rock. Formations without pore spaces, or with small, impermeable pore space, are also susceptible to pulse power drilling. In such dry formations, the plasma discharge occurs through the rock itself, which then suffers from dielectric breakdown, creating fissures and fault lines along the current path. Vaporization of fluid is a faster pulse power drilling method, but both mechanisms may be active in the same rock at the same time.

At the pressure and temperature of a wellbore, the ideal gas law is not a good approximate of the volume of a gas. The gas volume for hydrocarbons is modeled using the Wilson model, or another thermodynamically complex model or approximation. The volume of gas (such as $H_2$, $CO_2$, etc.) generated downhole—but not the volume of vapor generated (such as steam)—can be calculated from the volume of gas evolved at the surface. The volume of gas detected at the surface may be converted to a molar amount via the ideal gas law (see Equation 1 below).

$$PV=nRT \tag{1}$$

Where P is pressure, V is volume, n is the number of moles of the gas, R is the ideal or universal gas law constant and T is temperature in Kelvin. At high temperatures and pressures downhole, the ideal gas law approximation may be inaccurate and gas volume is calculated using Wilson's equation for a multi-component fluid (see Equation 2 below) or a similar equation.

$$\ln[\gamma_k] = 1 - \ln\left[\sum_{j=1}^{n}(x_j A_{kj})\right] - \sum_{i=1}^{n}\left[\frac{x_i A_{ik}}{\sum_{j=1}^{n}(x_i A_{ij})}\right] \tag{2}$$

Wilson's model determines the liquid phase activity coefficient $\gamma$ for component k as a function of the molar fraction $x_n$ of each of n components, where Aij, Aji are the Wilson coefficients for the binary pair of components i and j. The liquid phase activity coefficient $\gamma$ is related to the partial pressure of each compound in the fluid via Raoult's law (Equation 3) or a similar approximation.

$$p_k=x_k\gamma_k p_k^{\sigma} \tag{3}$$

In Raoult's law, $p_k^{\sigma}$ is the saturation pressure or vapor pressure of the undiluted component (i.e. of each component in its pure form).

Current flows from the anode 202 to the cathode 204, which corresponds to a flow of the electrons 206 from the cathode 204 to the anode 202. The electrons 206 are injected from the cathode 204 into the dielectric under the influence of the electric field generated between the anode 202 and the cathode 204. The electric field may be approximated for a parallel plate capacitor as given by Equation 4 below:

$$E = \frac{\Delta V}{d} \tag{4}$$

Where E is the electric field (in Volts (V) per meter or another unit) for a parallel plate capacitor approximation for electrodes separated by a distance d and at a voltage difference of $\Delta V$. The electric field between the anode 202 and the cathode 204 is not uniform if the formation is not microscopically uniform, which is true for any formation strata with fluid filled pores. The average electric field may be approximated as shown in Equation 5:

$$E \sim \frac{\Delta V}{d} \tag{5}$$

Where $\overline{E}$ is the average electric field in the dielectric between the electrodes, ΔV is the voltage drop from anode to cathode (or between the electrodes, generally) and d is the separation distance between the electrodes.

The electrons 206 accelerate in the electric field in the dielectric until they experience a collision with particle. The collision of charged particles in a plasma may generate an avalanche multiplication current, as described by Townsend (and further explain in reference to FIGS. 5A-5B). Similarly charged particles repel each other, but neutral and opposite polarity particles experience collisions at appreciable rates. The electron 206 collides with water molecule 218 leading to the generation of an additional electron. This collision would be governed by the hydroxide ion chemical formation shown in Equation 6 below.

$$e^- + H_2O \leftrightarrow \tfrac{1}{2}H_2 + HO^- + 2e^- \tag{6}$$

Where $e^-$ represents electrons and $HO^-$ represents hydroxide ions. Another reaction pathway, shown in Equation 7, generates hydroxyl radicals but no additional electrons.

$$e^- + H_2O \leftrightarrow \tfrac{1}{2} + H_2 + HO\cdot + e^- \tag{7}$$

Where HO. represents a neutral hydroxyl radical, and where free radicals or radicals are electrically neutral molecules with at least one unpaired electron and may be very reactive. In this way, the plasma generates high energy particle collisions that produce chemical reactions downhole.

A portion of the electric current travels not between the cathode and anode, but out into the formation as plasma sparking. The portion of the plasma power that generates a plasma spark 216 or sparking does not lead to appreciable current transfer between the anode and cathode—although current may flow to ground or into the formation. Sparks of plasma typically have higher plasma temperatures than arcs of plasma, as will be discussed in more detail below in reference to FIGS. 5A-5B, which affects the types of products generated and their reaction rates. Plasma sparks also vaporize fluid, breakdown rock, and contribute to drilling. Plasma sparks may be undesirable because they unevenly form at one electrode, instead of dissipating power equally between both anode and cathode. However, plasma sparks may be useful in directionally modifying drilling such as when turning the wellbore is required.

FIG. 2C depicts electrodes of a pulse power drill string at the bottom of a wellbore after emission of a pulse into the formation, according to some embodiments. The vaporization of the formation fluid generates expansive gases. As the plasma is quenched, the gasses are dissolved into the high-temperature and high-pressure drilling fluid. The formation solids (rocks or particulates), having been broken into smaller pieces by the plasma, are carried away as cuttings by the drilling fluid. The destruction of the solid matrix frees fluid 220 formerly trapped in pore spaces within the rock. However, the fluid 220 from the regions where plasma was generated is no longer formation fluid but rather plasma reaction products. This too travels to the surface dissolved in the drilling fluid to be analyzed and categorized.

Example Operations

A. Example Pulse Power Mud Logging Operations

Figure 3A:
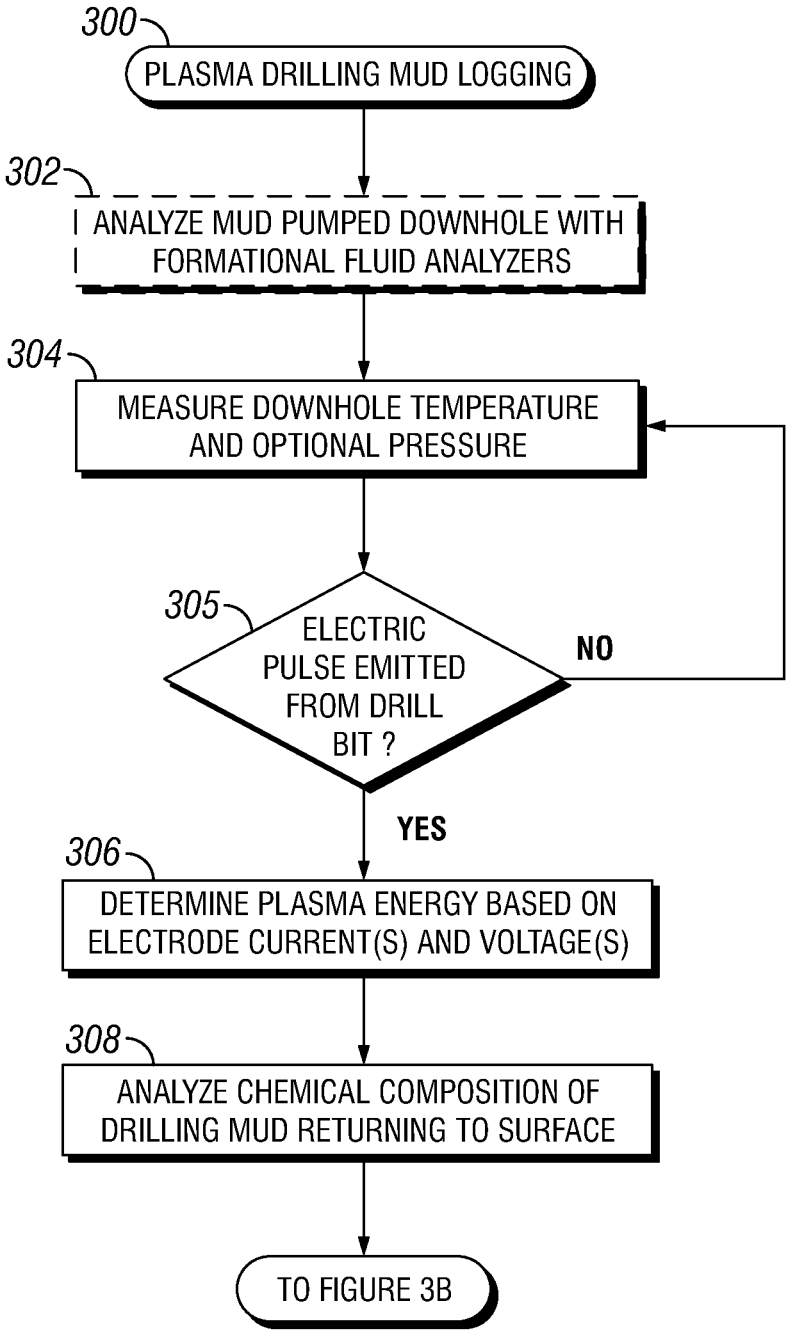
FIGS. 3A-3B depict a flowchart of example operations for pulse power mud logging, according to one or more embodiments.
Figure 3B:
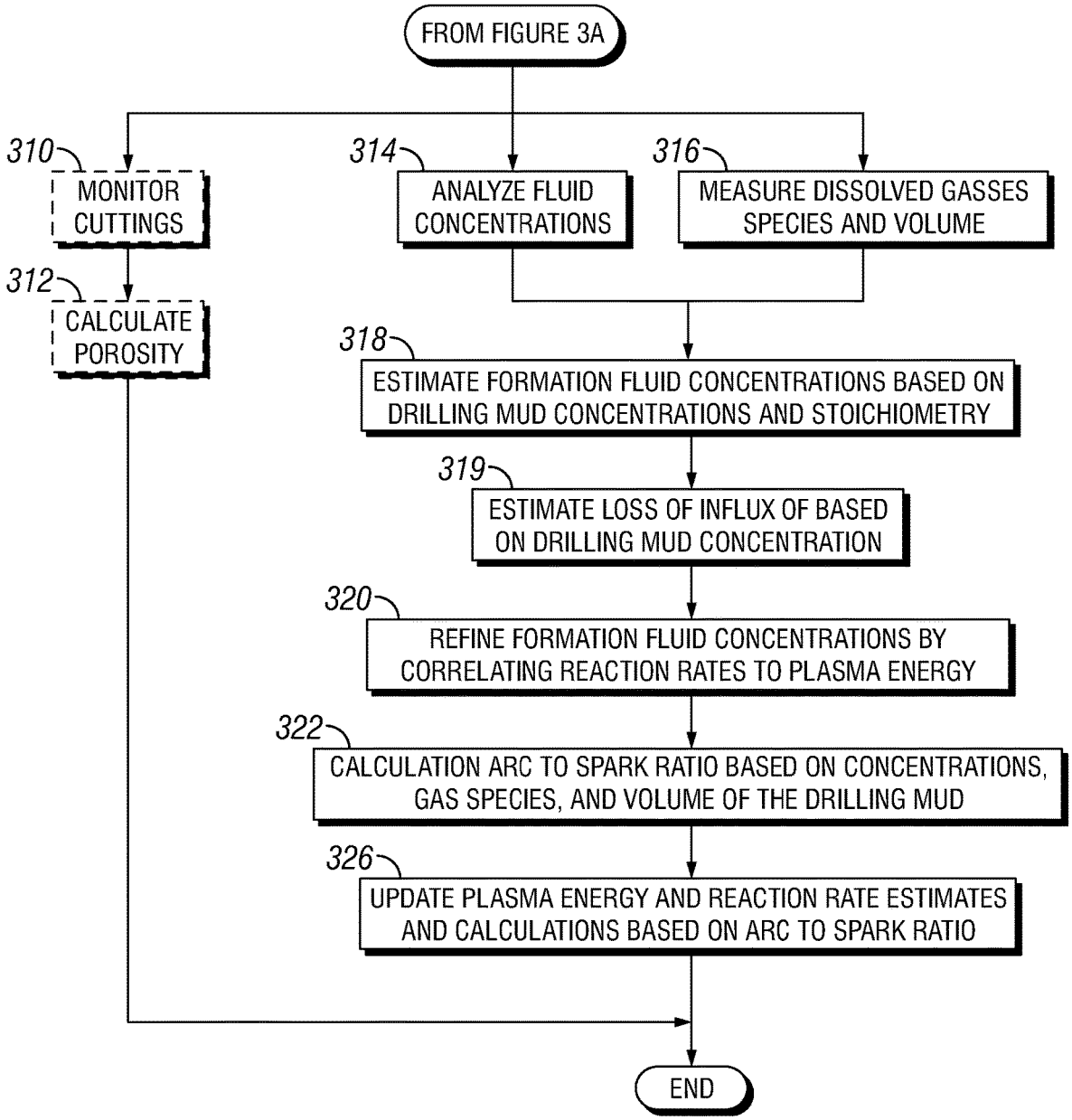

FIGS. 3A-3B depict a flowchart of example operations for pulse power mud logging, according to one or more embodiments. A flowchart 300 of FIG. 3A and a flowchart 350 of FIG. 3B includes operations described as being performed by the pulse power drilling and mud logging system for consistency with the earlier description. However, program code naming, organization, and deployment may vary due to arbitrary programmer choice, programming language(s), platform, etc. The flowchart 300 includes blocks 302, and the flowchart 350 includes blocks 310, 312, and 330 depicted with broken lines. Such blocks represent examples of operations that may be optionally performed. This depiction of the blocks of the flowchart 300 and the flowchart 350 should not be interpreted as requiring operations in the blocks depicted with solid lines, as one or more other operations in the solid blocks may be optional also. Operations of the flowchart 300 start at block 302, while operations of the flowchart 350 continue at blocks 310, 314, and 316 from block 308 of the flowchart 300.

FIGS. 3A-3B include operations related to plasma parameters, mud logging, and drilling optimization for an example pulse power drilling system. Pulse power mud logging includes several methods for determination of formation fluid and generation of mud logging records based on both downhole drilling measurements and on surface fluid characterization. The relationship between the chemical composition of drilling mud returned to the surface (including cuttings and solids, dissolved gasses, and liquid hydrocarbons) and the formation fluids entering the wellbore downhole may be complicated by the plasma pulses created while drilling and the destructive reactions thereby engendered. By iteratively or sequentially solving a number of groups of equations and balances, the total degrees of freedom of the system may be reduced so that the problem is solvable—that is the formation fluid concentration may be determined or back calculated. The determination steps are shown here in a particular order, which is illustrative only, and it should be noted that each balance, set of equations, or determination may be applied in any order, including stepwise or iteratively.

At block 302, drilling mud to be pumped downhole is analyzed with formational fluid analyzers. For example, with reference to FIG. 1, the instrumentation 161 may perform this analysis as the mud enters the wellbore to be pumped downhole. The concentration of hydrocarbon species in the drilling mud may measure using analyzers and detectors similar to those used to analyze the chemical composition of the drilling mud returned to the surface in block 308 (as further described below). Optionally, the same analyzers may be used to determine the composition of the drilling mud returned to the surface and the drilling mud entering the wellbore. Because the drilling mud circulates through the wellbore, chemical reactions downhole cause drift in the mud's chemical composition. Measuring the drilling mud's chemical composition as the mud enters the wellbore allows the mud logging system to account for the initial concentration of hydrocarbons and water (as shown in Equation 8) and determine the change in concentration for each iteration through the wellbore precisely.

$$\Delta P = [P]_{product} = [P]_{exiting\ wellbore} - [P]_{entering\ wellbore} \tag{8}$$

Where P is an example product molecule or species, [P] is a concentration of the example product and may be normalized for flow rate, rate (as of time), or volumetrically, and the concentration of P may change as a function of time of as a function of the total volume of drilling mud. AP represents the total change in product in the drilling fluid due to one cycle through the wellbore and corresponding exposure to plasma.

In some embodiments, if the drilling mud is not analyzed as it enters the wellbore, the drilling mud composition is assumed from the chemical composition of the drilling mud as it reaches the surface, which is determined at block 308, minus the concentration of gasses, which are removed from the drilling fluid before it enters the mud pit or another storage unit (as further described below in reference to block 316).

At block 304, temperature and, optionally, pressure downhole are measured. For example, with reference to FIG. 1, the information handling system 162 may perform this operation. The temperature of the drilling fluid may affect the reaction rate constants and plasma parameters, such as breakdown voltage, dielectric constant, etc. The mud logging system may correlate the downhole temperature to drilling mud analyzed at the surface by adjusting for drilling mud pumping speed and drilling speed.

At block 305, a determination is made of whether an electric pulse is emitted from the drill bit. As described above, the electrodes in the drill bit periodically emit an electric pulse to drill the borehole. For example, with reference to FIG. 1, the information handling system 162 may determine when the electric pulse is emitted. If there is no electric pulse emitted, operations of the flowchart 300 remain at block 304. Optionally, flow may continue to block 308 in the absence of a detected pulse and perform mud logging calculations based on possible plasma reaction products in drilling mud that may result from previous reactions. The drilling mud circulation time causes a temporal mismatch between when the pulse is detected and when the products are detected and analyzed at block 308. Otherwise, operations of the workflow 600 continue at block 306.

At block 306, the plasma energy is determined based on electrode current(s) and voltage(s). For example, with reference to FIG. 1, the information handling system 162 may make this determination. The plasma energy may be determined based on anode and cathode current and voltage of the drill bit. Plasma power calculations may assume that power added to the system is approximately equal to the plasma power, or may account for power lost to the formation, heat of vaporization, etc.

In a closed-loop system where electrons are neither created nor destroyed, the current flowing through the system may be determined based on current measured at the anode (the anode current) and at the cathode (the cathode current) as given by Kirchhoff's current law. Kirchhoff's current law does not apply in a plasma, as the acceleration of electrons in the electric field of the plasma may cause Townsend avalanche multiplication, as will be discussed later. Electrons and positive ions may be created in the plasma. However, the electrons and positive ions may recombine when the plasma generation ends to form neutral molecules which are the reaction products. Once initiated, the plasma itself may be considered a conductor of infinite conductivity or zero resistance.

When the anode and cathode currents are equal and the plasma is quenched, no current flows into the formation or away to ground. If the anode and cathode currents are unequal, the difference may represent current lost to the formation or current created by the electrons and ions generated by the plasma. Current lost to the formation may be approximated as current lost to ground where the formation functions as a grounding electron sink. The relationship between anode, cathode, and formation current is then given by Equation 9 below:

$$I_{anode}=I_{cathode}+I_{formation}+I_{plasma} \tag{9}$$

Where $I_{anode}$ represents the current flowing out of the anode, $I_{cathode}$ represents the current flowing into the cathode, and $I_{plasma}$ represents any additional current generated by the plasma. $I_{formation}$ represents any current lost to the formation or otherwise away from the anode or cathode, or another electrode. For pulse power drilling in a wellbore, the formation current is approximately the ground current as shown in Equation 10, below:

$$I_{formation}\approx I_{ground} \tag{10}$$

Where $I_{ground}$ is the current lost to or gain from ground, which is approximately the formation or earth acting as an electron sink. $I_{formation}$ and $I_{ground}$ may or may not be measurable.

Plasma may form in the combination of drilling mud, rock or formation, and formation fluid when the applied voltage is above the dielectric breakdown voltage of that combination, for the downhole temperature and pressure. At voltages above breakdown, electrons separate from molecules, generating positive ions. The electrons have much smaller mass than the positive ions and accelerate in the electric field towards the anode. In a low-pressure plasma, the mean free path of the electrons may be long, and the electrons may experience significant acceleration. Very fast electrons may generate additional electrons through the Townsend avalanche multiplication when they collide with positive ions or neutral molecules on their way to the anode. In a high-pressure plasma where free electrons may be drawn from ground, such as found when drilling in a formation, the mean free path of the electron may be so short that avalanche electron multiplication is negligible. In either case, the increase in current generated by the plasma is encompassed by the term $I_{plasma}$.

The value of the Townsend current is given by Equations 11-12, below:

$$I = I_0 e^{\alpha_n d} \tag{11}$$

$$I = I_0 \frac{(\alpha_n - \alpha_p)\mathrm{Exp}[(\alpha_n - \alpha_p)d]}{\alpha_n - \alpha_p \mathrm{Exp}[(\alpha_n - \alpha_p)d]} \cong I_0 \frac{\mathrm{Exp}[\alpha_n d]}{1 - \alpha_p / \alpha_n \mathrm{Exp}[\alpha_n d]} \tag{12}$$

$I_0$ represents current generated at the cathode surface (which may be approximated as $I_0=I_{cathode}$), $\alpha_n$ is the first Townsend ionization coefficient, $\alpha_p$ is the secondary ionization Townsend coefficient, and d is the distance between the anode and cathode of a parallel plate capacitive discharge. $\alpha_n$ represents the number of particle pairs generated by a negatively charged particle (anion or electron) per unit length, where such a negative particle is moving from cathode to anode. $\alpha_p$ represents the number of charged particle pairs generated per unit length by a cation, during its collisions while moving from anode to cathode. Equation 11 considers only electrons traveling at speeds sufficient to cause ionization collisions (i.e. a non-thermal plasma), while Equation 12 also considers positive ion (i.e. cation) traveling fast enough to impart ionization energy to neutral particles (i.e. a thermal plasma).

For a downhole plasma where d is known, the plasma current may be determined or estimated based on an exponential fit to the anode and cathode currents. The exponential portion of the increase in current during the lifetime of the plasma results from the avalanche multiplication in the plasma. Current lost to the formation or ground should exhibit only minimal capacitive or inductive charging (i.e. current that depend exponentially on time) and is predominantly resistive in nature and therefore distinguishable from the plasma current.

A plasma arc may be defined as a plasma generated between the cathode and anode along with a significant transfer of current. A plasma spark may be defined as a non-directional or isotropic plasma without a directional current transfer. Plasma arcs between the cathode and anode and through the dielectric that may include the formation fluid, formation, and drilling mud, but may also arc between either of the electrodes and the formation or subsections of the formation. Plasma arcs may be detectable from their effect on the cathode and anode currents. Plasma sparks, where electrons are not accelerated appreciably between the cathode and anode, may be detectable via their drawn down of voltage (or power) from the anode and cathode. Plasma arc and plasma sparks may have fundamentally different plasma temperatures and geometries, which may lead to different high-energy transition states and chemical reactions, which will be discussed in more detail below in reference to FIGS. 5A-5B. For pulse power generation, the determination of a ratio between a plasma arc and plasma sparking may be estimated via electrical measurements and further or iteratively refined based on concentration of chemical products and determination of reaction rates from surface stoichiometric analysis.

The power added to the system may be determined by the current flowing through and the voltage drop over the system. If the cathode and the formation are at 0 volts (V) or ground, then the total power added to the system is given by the anode current multiplied by the anode voltage, as given by Equation 13 below:

$$P=I_{anode}V_{anode} \tag{13}$$

Where P represents power in this instance (in units of Watts or equivalent), $I_{anode}$ is the current flow at the anode electrode, and $V_{anode}$ is the electric potential (or voltage) of the anode. Equation 14 describes the general relationship between power, current, and voltage for electric systems.

$$P=IV \tag{14}$$

Where power P is equal to current, I multiplied by voltage V.

If the cathode is not also a ground source or if information about the current and voltage at the cathode is known, then the power added into the system is given by the approximation of Equation 15, below.

$$P=I_{anode}V_{anode}-I_{cathode}V_{cathode} \tag{15}$$

Where $I_{cathode}$ is the current flow at the cathode electrode and $V_{cathode}$ is the electric potential of the cathode (which is the same as its voltage).

The plasma power, i.e. the power consumed to generate the plasma, may be assumed to account for the power input into the system. The plasma power approximation may be iteratively updated as a function of time. For a system where only the current at one electrode or the total power added to the system is known, the plasma power may be correlated to reaction rates, activation energies, and product concentrations instead of directly calculated. Pulse power discharges of similar power may be assumed to have similar properties, including spark vs. arc ratio, reaction rates, etc.

The power balance represents an instantaneous energy balance, where power is energy per unit time. The total energy balance of the system also provides information about the plasma power. For a plasma pulse of known duration, energy balance equations may be substituted for power balance equations. In this case, the total energy of formation of the products relates to the power or energy of the plasma. If products and product concentrations of the chemical reactions are known, a total chemical energy balance may be determined based on the enthalpy of formation of the product species and the temperature and pressure at which the reactions occur.

In either case, the power or energy of a given plasma pulse is correlated to the products of such a reaction which reach the surface at a time delayed from the reaction. Traditional mud logging correlates drilling mud chemical constituents to the depth at which they entered the borehole. Pulse plasma mud logging additionally correlates drilling mud chemical constituents to a specific reaction time, current, and voltage in order to back calculate formation fluid properties. The lag between pulse power reaction and drilling mud arrival at the surface is determined based on drilling rate, circulation rate, and drill depth.

For a DC plasma, current will vary with time, even during the plasma pulse itself. Before the plasma is generated, the current is low and the resistivity between dielectric between the anode and cathode (which may be modeled as the drilling fluid resistivity, formation rock resistivity, and formation fluid resistivity in parallel) is high. The voltage between the anode and cathode builds as the cathode is charged until the voltage applied over the dielectric is greater than the dielectric's breakdown voltage and a plasma is generated.

The resistivity of the plasma is low, and it may be modeled as a conductor of zero resistivity between the anode and cathode. If there are available free electrons in the system, an approximation applicable when electrons may be drawn from ground or stripped from water molecules in the drilling fluid, the current generated by the plasma may be estimated by the Townsend discharge equations (Equations 11-12, above) or determined via Kirchhoff's law from the other known currents.

A plasma is overall electrically neutral—the electrons generated by the avalanche cascade reactions are compensated by free electrons absorbed from ground or generated by ionization. The number of positive ions (cations) and electrons (where the contribution of anions may be approximated as $n_a \approx 0$) are approximately equal. The degree or fraction of ionization for a plasma is given by Equation 16, below:

$$f_i = \frac{n_e}{(n_e + n_0)} \tag{16}$$

Where $n_e$ is the number of electrons, no is the number of neutral atoms or molecules, and $f_i$ is the ionization fraction.

Each particle in the plasma has a kinetic energy. Because there are so many electrons, ion, and atoms or molecules, the kinetic energy is oven expressed as an energy distribution or particle temperature. The plasma temperature of electrons is given in Equation 17, below for a Maxwell-Boltzmann distribution.

$$T_e = \frac{2}{3}\frac{\langle E \rangle}{k_B} \tag{17}$$

Where $T_e$ is the electron temperature, ⟨E⟩ is the average plasma energy, and $k_B$ is the Boltzmann constant. The Maxwell-Boltzmann probability distribution describes a distribution of particle kinetic energy or speeds at thermodynamic equilibrium and is commonly used in statistical mechanics to approximate particle velocities and interactions as a function of temperature. Electron temperature is a fundamental measure of the energy of the electrons in a plasma and is used to calculate other plasma properties, such as collision rate, mean free path, etc., and is often given in units of Kelvin (K) or electron Volts (eV).

Plasmas are classified as either thermal, where anions, cations, and electrons have similar kinetic energy (i.e. are in thermal equilibrium) and non-thermal, where electrons alone have kinetic energy proportional to the plasma energy. The first plasma of the plasma pulses generated is generally a non-thermal plasma where the electrons of the plasma have a higher kinetic energy than the ions and molecules of the plasma. Thermal plasmas are generated from non-thermal plasmas as energy added to the plasma in the form of current and voltage increased the kinetic energy of the charged particles until they reach the same kinetic energy as the electrons. Thermal plasma are more common in alternating current (AC) and long lifetime plasmas, but may occur in DC plasmas and pulsed plasmas where the dielectric is sufficiently heated before the plasma is initiated (either by environmental heating or by previous plasma produced through the same dielectric). For a thermal plasma approximation as shown in Equation 18 below:

$$T_a = T_c \approx T_h = T_e \tag{18}$$

Where particle temperatures include anion temperature $T_a$ and cation temperature $T_c$. Both anions and cations are heavier (i.e. more massive) then electrons and are approximately equal to a heavy particle kinetic energy $T_h$. energy is added to the motion of the charged particles by the electric field based on magnitude of the charge not polarity.

Reaction rate constants for products generated in a plasma or at the quenching of the plasma depend on both the temperature of the plasma—electron temperature and heavy particle temperature—and upon the total ionization. By determining the reaction rates based on chemical concentrations in the drilling mud, the plasma temperatures may be monitored.

The average plasma energy <E> is related to both the energy applied to the plasma and to the electron temperature. The plasma power is related to the potential energy difference over the plasma (in Volts) times the work of moving the current (in Amperes) through the electric field. Power and energy are related, where power is energy per unit time (such as Watts), as shown in Equations 19 and 20 below.

$$\text{Power} = \frac{\text{Energy}}{\text{Time}} = \frac{\langle E \rangle}{\Delta t} \tag{19}$$

$$\text{Power} = \frac{\partial}{\partial t}\text{Energy} = \frac{\partial}{\partial t}\langle E \rangle \tag{20}$$

Where power may also be represented as P, energy as E, average energy as ⟨E⟩, and where t is time.

Reaction rates are a function of plasma temperature (which is a measurement of plasma energy), which means that plasma temperature may be calculated or correlated to measured reaction rates. Plasma power may be approximated from the power added to the system, and from the approximate plasma power and the plasma duration and an average plasma energy may be calculated. By comparing these two measures of plasma energy, the energy system may be checked for energy loss (i.e. energy lost to the formation may be detected). Either method may be used to approximate the other.

At block 308, the chemical composition of the drilling mud returning to the surface is analyzed. For example, with reference to FIG. 1, the instrumentation 161 may perform the analysis. The drilling mud may include both chemical reaction products and formation fluid acquired downhole, as well as solids in the form of formation cuttings. The drilling mud may be separated by phase, where cuttings and other solids (such as debris from the surface like gloves, bolts, etc.) are removed. To illustrate, a shaker and/or screen may receive the drilling mud from downhole and separate the cuttings and other solids from the drilling mud. For example, with reference to FIG. 1, the fluid recondition system 142 may perform this separation. The instrumentation 161 analyzes the solids at block 310 of FIG. 3B. The drilling mud logging system separates dissolved gasses via low-temperature or low-pressure separation from the hydrocarbon liquids. The gasses are then analyzed at block 316 of FIG. 3B, before being fed to a flare for disposal or safely stored. A portion of the cleaned drilling mud fluid may be diverted to allow the instrumentation 161 to analyze this fluid for chemical composition at block 314 of FIG. 3B.

At block 310, the cuttings may be analyzed to determine the volume of rock returned to the surface. For example, with reference to FIG. 1, the instrumentation 161 may analyze the cuttings. Methods of cutting measurement include optical scanning and image processing to determine particle size distribution, weighing of cuttings, and calculating volume based on a measured density (where the density is measured using a core sample or periodically for each formation layer), or via a large bore Coriolis density meter.

At block 312, porosity is determined based on the measurement of cuttings that occurred at block 310. For example, with reference to FIG. 1, the information handling system 162 may make this determination. The information handling system 162 may reconstruct the total volume of rock removed from the formation. The information handling system 162 may also compare that volume as a function of time to the drilling rate to determine the ratio of rock to pore space in the formation layer being drilled. The pore fraction ϕ is given by Equation 21:

$$\phi = \frac{V_v}{V_T} \tag{21}$$

Where the pore fraction ϕ is a dimensionless number representing the portion of the rock volume occupied by pores and where VT is the total volume and $V_V$ is the void volume. Void volume may be correlated to pore shape, pore size, and pore throat size (where pore throat size is a determining factor in permeability).

Porosity and permeability of the formation information may be determined in traditional mud logging from information about changes in the volume of drilling fluid and from measurements on the size and volume of cuttings. The plasma reaction downhole in pulse power drilling converts a portion of the drilling fluid and formation fluid to gas. Once the mass balance of the reaction is determined, the original volume of fluid downhole is determined. Based on the volume calculation, the drilling mud volume is further subtracted, and the remaining volume is a measure of formation fluid volume as a function of drilling depth. By accounting for formation fluid volume per unit of depth drilled, the percentage of formation rock that constitutes formation fluid space is calculated as a measure of porosity. The volume of rock fragments measured at the surface and the calculate pore volume equal the total volume drilled, as a function of time. Each method may therefore function as a check on the value of the other.

At block 330, permeability is determined based on porosity and electrical characteristics of plasma discharge, as will be discussed later. For example, with reference to FIG. 1, the information handling system 162 may make this determination.

At block 314, the chemical composition of the fluid is determined. For example, with reference to FIG. 1, the information handling system 162 may make this determination. The chemical composition of the fluid may include various hydrocarbons and water. The information handling system 162 may determine which chemicals are present and their concentration levels. The information handling system 162 may make this determination using the instrumentation 161 that may include application of gas chromatograph, liquid chromatography, mass spectrometry, absorption or emission spectrometry, nuclear magnetic resonance spectrometry (NMR), or the like.

At block 316, the molar concentrations of gasses produced by the plasma reaction is determined. For example, with reference to FIG. 1, the information handling system 162 may make this determination. The molar amount of gas produced may be determined based on the volume of gas detected at the surface, using the ideal gas law where each mole of gas corresponds to 22.4 L at standard temperature and pressure (STP).

At block 318, the formation fluid concentrations are estimated based on the concentrations of species in the drilling mud and estimated stoichiometry of a chemical reaction. This chemical reaction may be more specifically a dehydrogenation reaction, where hydrogen gas is produced from hydrocarbons as they form more saturated bonds (i.e. more double bonds). For example, with reference to FIG. 1, the information handling system 162 may perform this estimation. The information handling system 162 may determine the change in drilling mud species concentration by subtracting the concentrations of species found in the drilling mud pumped downhole (from block 302 or 308 depending on drilling rig set up). Based on the change in concentration that corresponds to the influx of formation fluid and chemical reactions generated by the plasma in the fluid at the drill bit, the information handling system 162 may solve the system of equations corresponding to the stoichiometric relationships and the reaction rate equations between the products and the potential reactants. For known or solvable stoichiometry, reactant concentrations may be calculated directly. For most systems, the stoichiometric equations generate a set of solvable equations with more degrees of freedom than encompassed by product concentration alone. For these systems, estimated reaction rate constants and reaction kinetics may be applied in order to determine reactant concentrations.

Drilling mud for traditional mechanical drilling requires properties that promote mechanical drilling and support pore pressure: i.e. density, viscosity, etc. Drilling mud for pulse power drilling is also an electrical transportation medium, which makes electrical properties, such as dielectric constant, breakdown voltage, resistivity, etc. important qualities. Both electrical and physical properties depend on chemical concentration of the constituent molecules are particulates of the drilling mud which is monitored in traditional mud drilling. Mud logging for pulse power drilling may also include calculation of the stoichiometry and reaction rate of the chemical reactions occurring downhole.

The rate at which a chemical reaction takes place, i.e. the rate at which reactants turn into products, is given by a generalized reaction rate, which depends on a reaction rate constant k(T) and on the concentration of reactants (usually in units of moles per unit volume). The reaction rate constant k may itself be a function of temperature, pressure, and activation energy. The reaction rate for a generalized $m+n^{th}$ order reaction is shown in Equation 22, below, for a rate-limiting step involve molecules of species A and B.

$$r=k(T)[A]^m[B]^n \tag{22}$$

Where r is the reaction rate, k(T) is the reaction rate constant, A and B are reactant molecules and the rate-limiting step involves m molecules of reactant A interacting with n molecules of reactant B, such as for a reaction mechanism described by a rate-limiting intermediate step shown in Equation 23 below:

$$m\cdot A+n\cdot B\rightarrow q\cdot P \tag{23}$$

Where m molecules of A and n molecules of B react to form q molecules of an example product molecule P.

The order of the reaction (zeroth order, first order, etc.) depends upon the reaction mechanisms and the rate-limiting step in the reaction and how many and which species of molecules participate in the rarest or slowest collision. The rate-limiting step is usually the slowest step of the elementary or intermediate steps that make up the reaction mechanism. For many chemical reactions, the reaction mechanism or the set of intermediate steps that occur when reactants become products has a single step or portion that is observably slower than all other steps. This step functions as a bottleneck or limit on the total reaction speed and is therefore known as the rate-limiting step. For a reaction with multiple intermediate steps, the rate-limiting step may depend on a catalyst molecule that is not a reactant or a product. For direct current (DC) plasmas with lifetimes in the microsecond (μs) to second range, many hydrocarbon formation reactions depend on intermediate steps involving hydroxyl free radicals, carbonyl free radicals or other free radicals with very short lifetimes, where free radical formation is therefore the rate determining step. Hydroxyl free radical formation and concentration is dependent on water concentration, not hydrocarbon concentration, and upon plasma energy and properties including plasma temperature and geometry. This gives rise to many zeroths and first order reaction rates for generation of alkenes, alkynes, aromatics, and other unsaturated hydrocarbons from alkanes. A zeroth order reaction rate, as shown in Equation 24, does not depend on the concentration of the reactants and have a rate constant with units of mol/s or equivalent.

$$r=k(T)[A]^0=k(T) \tag{24}$$

Where r is the reaction rate, k(T) is the reaction rate constant for a reaction with the rate limiting step that is independent of reactant concentration and where [A] is a reactant concentration. A first order reaction rate depends in the first order (i.e. $[A]^1$) on a reactant and has a rate constant with units $s^{-1}$ or equivalent, as is shown in Equation 25, below.

$$r=k(T)[A] \tag{25}$$

Where r and k(T) are the reaction rate and reaction rate constant, respectively.

The reaction rate constant k(T) depends on temperature and may be approximated using the Arrhenius equation, as shown in Equation 26 below:

$$k(T)=Ae^{-E_a/RT} \tag{26}$$

The Arrhenius equation relates the reaction rate constant k to the activation energy $E_a$, the absolute temperature Tin kelvin, the universal gas constant R, and a pre-exponential factor A representing the fraction of molecular collisions resulting in the chemical reaction out of all molecular collisions of the species of the rate limiting step. Alternatively, the Boltzmann constant $k_B$ may be used in place of R if the activation energy $E_a$ is also in units of $k_BT$. An exponential fitting factor R may also be used to correct modeled data to experimental data, as is shown for Equation 27.

$$k(T) = AExp\left[-\left(\frac{E_a}{RT}\right)^{\beta}\right] \tag{27}$$

Where β is a dimensionless fitting factor used to relate reaction rate constants to observable reaction rates, as a function of temperature.

Formation fluid may be approximated to a first order as containing alkanes, naphthenes (which is a generic name for the family of cycloalkanes), and water. Alkanes, which the general chemical formula $C_nH_{2n+2}$, contain single carbon to carbon bonds (σ bonds) between n $sp^3$ hybridized carbon atoms. Alkanes are saturated hydrocarbons which contain no carbon-carbon double bonds (π bonds) but are rather full hydrogenated—that is the carbon backbone or carbon chain is bonded to the maximum number of hydrogen atoms possible. Naphthenes, which are cyclic alkanes where the carbon chain loops back on itself, have the general chemical formula $C_nH_{2(n+1-r)}$ where n is the number of carbons in the cycloalkane and r is the number of rings in the naphthene molecule. Formation fluid may also contain water, such as salt water, when emanating from water rich rock formations or strata. The generalized chemical equation for the plasma reaction is approximated by Equation 28, below.

$$\begin{aligned}&A_n\cdot C_nH_{2n+2}+B_{n,r}\cdot C_nH_{2(n+1-r)}+D\cdot H_2O\rightarrow E_n\cdot C_nH_{2n+2}+\\&F_{n,r}\cdot C_nH_{2(n+1-r)}+G_n\cdot C_nH_{2n}+I_n\cdot C_nH_{2n-2}+J\cdot CO_2+\\&K\cdot O_2+L\cdot H_2\end{aligned} \tag{28}$$

The stoichiometric coefficients for each of the hydrocarbon species (i.e. $A_n$, $B_{n,r}$, $E_n$, $F_{n,r}$, $G_n$ and $I_n$) depend both on the number of carbons of the type of hydrocarbon (i.e. n) and the isomer (or atomic arrangement) of those carbons, but may be approximated as independent of isomeric configuration in order to simplify measurements. Table 1, below, contains names and formulas alkanes, alkenes, and alkynes as a function of the number of carbons they contain. As the molecules become larger (i.e. as n increases) the number of isomer molecules for each chemical formula increase, where isomers are various physical arrangements and chemical bonds possible for the same atoms. For n>2, polyunsaturated hydrocarbons also occur (i.e. hydrocarbons with two or more double bonds). Unsaturated hydrocarbons such as alkanes, are carbon molecules that contain only hydrogen and carbon and have the maximum number of hydrogen constituents possible for the given amount of carbon atoms. The ability to detect or differentiate hydrocarbons, including isomers, from one another depends on the specificity of instrumentation and is non-trivial.

TABLE 1

| Common Hydrocarbons | | | | | | | | |
|---|---|---|---|---|---|---|---|---|
| N | Formula | Alkane | Isomers | Formula | Alkene | Isomers | Formula | Alkyne | Isomer |
| 1 | $CH_4$ | Methane | 1 | | | | | | |
| 2 | $CH_3CH_3$ | Ethane | 1 | $CH_2{=}CH_2$ | Ethene | 1 | $HC{\equiv}CH$ | Acetylene | 1 |
| 3 | $CH_3CH_2CH_3$ | Propane | 1 | $CH_3CH{=}CH_2$ | Propene | 1 | $HC{\equiv}CCH_3$ | Propyne | 1 |
| 4 | $CH_3(CH_2)_2CH_3$ | Butane | 2 | $CH_3CH_2CH{=}CH_2$ | Butene | 4 | $CH_3C{\equiv}CCH_3$ | Butyne | 2 |
| 40 | $C_{40}H_{82}$ | | | $C_{40}H_{80}$ | | | $C_{40}H_{78}$ | | |

In general, the products of the chemical reaction of Equation 28 have higher enthalpy or energy of formation that the reactants, which will be described in more detail below in reference to FIGS. 5A-5B. This higher energy corresponds to the energy balance, where the energy added to the plasma is stored in higher order chemical bonds and endothermic reactions are favored by high energy transition states.

The stoichiometry balance of the reaction may be determined based on the measured composition of the drilling fluid. The drilling fluid is measured as it exits the wellbore-hydrocarbon concentrations are measured as are types and volumes of evolved gasses. The composition of the drilling mud pumped downhole is either measured as circulates back downhole, or the measured composition of the drilling mud returned to the surface is set as the drilling mud concentration when that mud recirculates into the wellbore. In either case, an initial drilling mud concentration is subtracted from a final drilling mud concentration, which generates the change in concentration for various species occurring downhole.

Figure 4A:
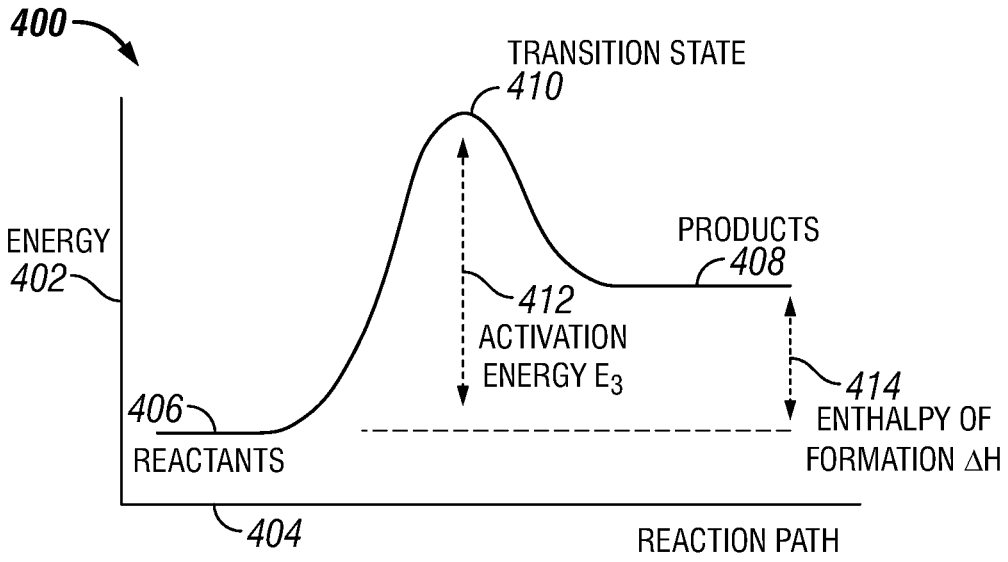
FIG. 4A depicts an example line graph of the reaction kinetics and reaction path of an example plasma-mediated chemical reaction, according to one or more embodiments.

To help illustrate, FIG. 4A depicts an example line graph of the reaction kinetics and reaction path of an example plasma-mediated chemical reaction, according to some embodiments. In particular, FIG. 4A depicts a graph 400 having a y-axis for energy 402 and an x-axis for a reaction pathway 404. The graph 400 depicts example reaction kinetics and molecular energies for example reactants and products of a pulse plasma. The plasma energy, which is the energy added to the system consumed to generate the plasma, may create highly energized particles, both kinetically energized and energized electronically above the ground state. Energized molecules and atoms therefore interact more frequently and may form transition states favorable to reaction. The graph 400 depicts an example reaction pathway (also known as a reaction path) for a set of reactants, their intermediate transition state, and the final products of the example reaction. Activation energy $E_a$ 412 is the energy per set of reactants or per reaction needed to reach transition state 410, where the transition state 410 is a complex formed between the atoms of the reactant molecules that is the highest energy state during the chemical transformation from the reactant species to the product species.

For most of the hydrocarbon reactions occurring in the plasma, reaction products 408 will have a greater enthalpy of formation 414 than reactants 406 (i.e. higher energy 402). Enthalpy of formation is a measure of the energy contained within a molecule as a sum of the energies contained within the chemical bonds between the constituent atoms. The plasma energy may be defined as the total energy in the plasma. The plasma energy added to the fluid is stored in higher order carbon bonds. Each molecular reaction may store the enthalpy of formation 414 (as an amount of energy) within the reaction products' 408 chemical bonds. The reaction energies include the activation energy $E_a$ 412 and the enthalpy of formation 414 and may be defined as the energy needed for a set of reactants 406 to reach the transition state 410 or stored in the reaction products 408. The reaction energy may be measured on a per reaction or molar basis. When species collide and react, the frequency at which the transition state 410 arrangement of the hydrocarbon is reached is a function of the kinetic energy added to the molecule through absorption of a photon, stabilized via hydroxyl, or other catalysis processes. In a plasma, the kinetic energy of the particles is high because the plasma energy is high. The plasma energy is a measure of the kinetic energy of the particles and molecules within the plasma, and higher energy transition states are allowed (and occur more frequently), as shown along the reaction pathway 404.

In the graph 400, the reaction pathway 404 is a simplified timeline of the reaction, going from the reactants 406 to the reaction products 408 (showing an intermediate step—the transition state 410). Reaction mechanisms, which include possible reaction pathways and intermediate steps, may be much more complicated. A reaction mechanism may be defined as the series of steps and chemical rearrangements that occur during a reaction at a molecular level, where reactants transform into products. A reaction mechanism may include intermediate steps, some of which may lead to formation of multiple different reaction products. A reaction path or reaction pathway may be defined as the method or steps of the reaction mechanism which lead from a set of reactants to a set of reaction products. A reaction may have more than one pathway that generates identical reaction products from reactants (as will be discussed in reference to FIG. 4B), and each pathway may have a different activation energy and reaction rate. For instance, catalysts may stabilize transition states thereby lowering activation energies and increasing the speed of a given reaction rate, but even in catalyzed reactions a portion of the products may be generated through the higher energy uncatalyzed transition state. Reactions, including intermediate reaction steps, may also be reversible which means that a significant portion of the reaction products re-react to re-from the reactant species. Dehydrogenation reactions tend to be irreversible because the gaseous reaction products quickly dissociate from the hydrocarbon species, but transition states in dehydrogenation reactions are likely to form reaction products or to re-form reactants.

Plasma energy (of the entire plasma) and reaction energy (of each individual chemical reaction) may be correlated—higher plasma energy favors reactions with larger activation energies and greater enthalpy of formation. The concentration of product species multiplied by the enthalpy of formation of each species generates a total reaction energy for the chemical reactions within the plasma that may be compared to the plasma energy.

Figure 4B:
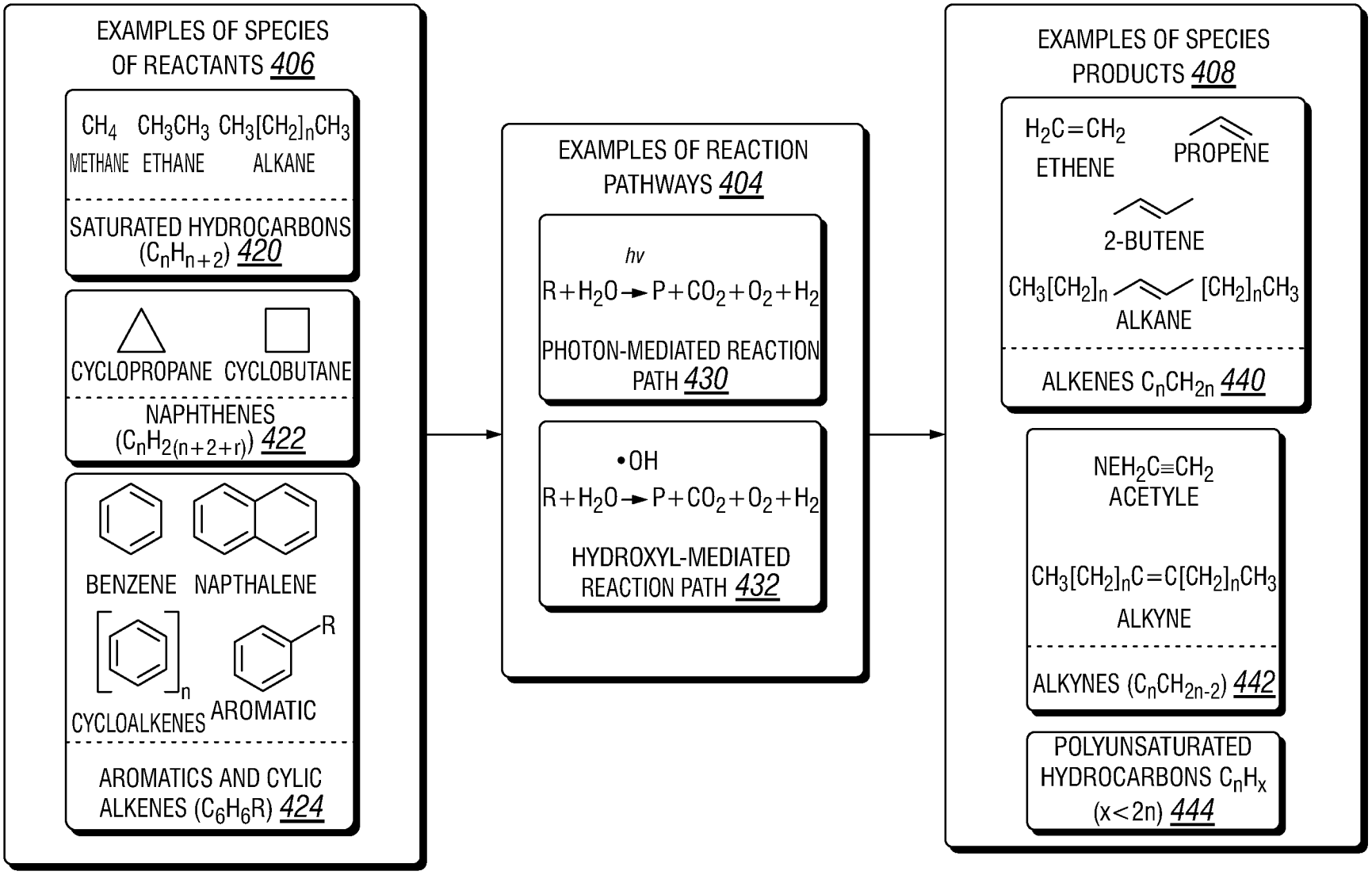
FIG. 4B depicts example reactants and products as well as example reaction pathways, according to one or more embodiments.

To further illustrate, FIG. 4B depicts example reactants and products as well as example reaction pathways, according to some embodiments. FIG. 4B depicts examples of species of reactants 406, examples of reaction pathways 404, and examples of species of reaction products 408. In order to calculate the formation fluid concentration, a set of equations based on reaction rate constant and final or product concentration may be generated. For a generic product molecule, P, of the first order reaction shown in Equations 29 and 30, the final concentration [P] may be known and measured at the surface during drilling mud analysis.

$$R \rightarrow P \tag{29}$$

$$r = k(T)[R] = -\frac{d[R]}{dt} = \frac{d[P]}{dt} \tag{30}$$

Where R is a generic reactant and P is a generic product of the first order reaction of Equation 29. [R] is a concentration of molecule R, [P] is a concentration of molecule [P], r is a reaction rate, and k is a reaction rate constant which is a function of temperature T.

Product species P may include at least one species from at least one of alkenes 440, alkynes 442, polyunsaturated hydrocarbons 444, and any of those species included corresponding to reactant species R. Reactant species R may include species from at least one of the alkanes or saturated hydrocarbons 420, the naphthenes 422, or the aromatics and cyclic alkenes 424, as may be found in the formation fluid. If the reaction rate constant k(T) is also known, the reactant concentration [R](which is the formation fluid concentration) for a generic product R is directly calculable according to Equation 31-33 below.

$$[P] = r * \Delta t = k(T)[R] * \Delta t \tag{31}$$

$$[P] = \int r dt = \int k(T)[R] dt \tag{32}$$

$$[R] = \frac{[P]}{k(T) * \Delta t} \tag{33}$$

Where the concentrations of P and R change as the reaction occurs. Concentration changes may be large enough that the change in reactant concentrations favors the use of integrals (as shown in Equation 32) instead of discrete analysis (as shown in Equations 31 and 33). The instantaneous product concentrations may not be known, as may occur when drilling mud circulation prevents instantaneous measurement of chemical reaction products. If the instantaneous concentrations are not known, the reaction rate and reactant concentration may be approximated using integral approximation, such as for an exponential concentration approximation, or discrete analysis.

A product molecule(s) P may be generated from a reactant molecule(s) R via an example photon-mediated reaction pathway 430 or an example hydroxyl-mediated pathway 432. The ratio between reactions catalyzed by light and those catalyzed by hydroxyl free radicals may correspond roughly to the ratio between plasma arc and plasma spark.

For the set of alkane dehydrogenation reactions (which may be considered to be the opposite of cracking reactions) encompassed by Equation 28 (set forth above), the molar concentrations of hydrogen, carbon dioxide, and oxygen gases may be determined at the surface. From the oxygen mass balance of the chemical reaction, the relationship between coefficients D, J, and K is determined, as shown in Equation 34.

$$D=2(J+K) \tag{34}$$

Where D is the stoichiometric coefficient for water, J is the stoichiometric coefficient for carbon dioxide, and K is the stoichiometric coefficient for hydrogen as defined in the chemical reaction of Equation 28. This allows the initial concentration of water to be calculated based on the measured molar concentrations of carbon dioxide and oxygen measured at the surface, as is shown in Equation 28.

$$[H_2O]=2([CO_2]+[O_2]) \tag{35}$$

The mass balance of the carbon and hydrogen atoms may be complicated by the multiplicity of the hydrocarbon species. The chemical analysis does not necessarily determine a concentration for each isomer of the saturated and unsaturated hydrocarbons. Isomer concentrations, where available, may refine available mass balance equations. The chemical analysis equipment may identify concentrations of hydrocarbons as a function of n and carbon to hydrogen (C/H) ratio with great specificity. The total carbon balance is given by Equation 36 and the total hydrogen balance is given by Equation 37.

$$\sum_{i=1}^{n} i*A_i + \sum_{i=1}^{n}\sum_{j=1}^{r} i*B_{i,j} = \sum_{i=1}^{n} i*E_i + \sum_{i=1}^{n}\sum_{j=1}^{r} i*F_{n,j} + \sum_{i=1}^{n} i*G_i + \sum_{i=1}^{n} i*I_i \tag{36}$$

$$\sum_{i=1}^{n} 2(i+)*A_i + \sum_{i=1}^{n}\sum_{j=1}^{r} 2(i+1-j)*B_{i,j} + 2D = \sum_{i=1}^{n} 2(i+1)*E_i + \sum_{i=1}^{n}\sum_{j=1}^{r} 2(i+1-j)*F_{n,j} + \sum_{i=1}^{n} 2i*G_i + \sum_{i=1}^{n} 2(i-1)*I_i + 2L \tag{37}$$

Again, the stoichiometric coefficients for each of the hydrocarbon species (i.e. $A_n$, $B_{n,r}$, $E_n$, $F_{n,r}$, $G_n$ and $I_n$) come from Equation 28 previously and represent the total equation mass balance for each of the carbon species with n carbons.

The stoichiometric coefficients for the hydrocarbon species—$A_n$, $B_{n,r}$, $E_n$, $F_{n,r}$, $G_n$ and $I_n$—appear in both the carbon mass balance and the hydrogen mass balance (which also includes coefficients D and L). The stoichiometric coefficient D, J, and K are related based on the oxygen balance previously discussed in relation to Equations 34 and 35. The stoichiometric coefficients are constrained by these equations, which becomes a solvable system of equations for coefficients of the reaction.

The final concentrations of species may also be known, where $[CO_2]$, $[O_2]$, $[H_2]$ may be measured directly. If not all water is consumed during the plasma-driven chemical reaction, the initial concentration of water may be calculated directly from the gaseous product concentration and the final concentration of water in the drilling fluid, given by Equation 38.

$$[H_2O]_{initial}=[H_2O]_{final}+2([CO_2]_{final}+[O_2]_{final}) \tag{38}$$

Where initial denotes the concentration in the formation fluid and drilling mud downhole before the plasma reaction, and final denotes the concentrations measured in the drilling fluid after the reaction (either at the surface or with analysis equipment downhole). If the drilling mud contains water when it is pumped downhole, the formation fluid's water concentration may then be given by Equation 39, which accounts for a change in water concentration due to formation fluid influx.

$$[H_2O]_{initial}=\Delta[H_2O]_{drilling\ fluid}+2([CO_2]_{final}+[O_2]_{final}) \tag{39}$$

Where the change in drilling concentration in the drilling fluid is represented by Δ, which is the change in the water concentration measured in the drilling fluid before and after the reaction.

Product hydrocarbon concentration $[C_nH_{2n+2}]$, $[C_nH_{2(n+1-r)}]$, $[C_nH_{2n}]$, and $[C_nH_{2n-2}]$ may also be known. The known and unknowns together create a system of equations where the initial formation concentrations are solvable. Further, reaction kinetics allow refining of the concentrations based on known product concentration and calculable reaction rates, as shown in Equations 24-25 (set forth above).

If reaction rates are known (i.e. may be calculated based on product concentrations as a function of time) and the reaction order of the rate limiting step (i.e. first order, second order, etc.) is known, then exact concentrations of reactants are calculable from product concentrations. For hydrocarbon dehydrogenation, most reaction rates are first order or zeroth order. Zeroth order reactions depend on time, not on reactant concentration (to a first approximation). Product concentrations follow Equation 40.

$$[P]=k(T)*\Delta t \tag{40}$$

Where [P] is the concentration of a generic product molecule P and Δt is the lifetime of the reaction. These types of reaction kinetics correspond to chemical reactions dependent on free radicals, equilibrium rearrangement at high temperature (such as for hydrocarbon isomers in equilibrium), and for catalyzed reactions where k may be zeroth order with respect to reactants but depend on the concentration of a catalyst. For first order reactions, product concentrations may be related to reactant concentrations as shown in Equation 41.

$$[P]=k(T)[R]*\Delta t \tag{41}$$

Where [R] is the concentration of a generic reactant molecule R. Where the concentration of R is also a function of time, this equation becomes $$[P]=\int k(T)[R]dt \tag{42}$$

In general, the concentration of a first order reactant as a function of time is given by solving the rate equation to get Equation 43, below:

$$[R]=[R]_0e^{-k(T)*t} \tag{43}$$

Where $[R]_0$ is the initial concentration of generic reactant R, k(T) is the reaction rate constant, and t is time. Substituting Equation 43 into Equation 42 yields equation 44:

$$[P]=\int k(T)[R]_0e^{-k(T)*t}dt=k(T)[R]_0\int e^{-k(T)*t}dt=[R]_0e^{k(T)*t} \tag{44}$$

Where this relationship holds when one molecule of reactant R yields one molecule of product P. The product concentration for first order reactions may be similarly related to reactant concentrations for different stoichiometric relationships as well.

By correlating reaction rate constant to temperature and plasma power, rate constant values are further refined. The rate constant for a plasma reaction may be a function of temperature, plasma power, and activation energy. Activation energy for transition states are known. Determination of a reaction rate constant for a first order reaction may be made by varying the plasma power (where temperature is constant, and activation energy is a function of the transition state and therefore constant for the specific reaction mechanism). This is shown in Equations 45-47, below, where the reactant concentration [R] is a function of the formation and does not vary over the time scale of the power analysis.

$$[P]_1 = k(T, PW_1)[R] * \Delta t = [R]_0 e^{k(T,PW_1)*t} \tag{45}$$

$$[P]_2 = k(T, PW_2)[R] * \Delta t = [R]_0 e^{k(T,PW_2)*t} \tag{46}$$

$$\frac{[P]_1}{[P]_2} = \mathrm{Exp}[k(T, PW_1) - k(T, PW_2)] = f\left(\mathrm{Exp}\left(\frac{PW_1}{PW_2}\right)\right) \sim f(PW) \tag{47}$$

Where P represents the product concentration and PW represents the plasma power. PW is used so that power is not confused with either product concentration [P] or pressure as used previously. Subscripts 1 and 2 denote a first power setting its corresponding concentrations, temperature, and time, and a second power setting its corresponding concentrations, temperature, and time. T is temperature and t represents time. The power analysis may be simplified if all time and temperatures remain constant while power is varied, so that the relationship between k(T) and power may be explored.

The dependence of the rate constant on plasma power may be determined from the product concentrations as a function of power. Once the relationship between rate constant k and plasma power is known, then the relationships between reactant concentration and product concentration may generate another set of equations that further restrict the degrees of freedom of the system.

The reaction rate constants may also vary by plasma type. For example, the reaction rate constants for plasma arcs may be different than the reaction rate constants for plasma sparks even for similar products and reactants over the same rate limiting step. Certain reaction products are favored by different types of plasma, as previously discussed in relation to hydroxyl free radical formation and hydroxyl mediated versus photon mediated reaction pathways. Reaction rate constants for each type of plasma may be determined via at least one of a plasma power analysis or a spark versus arc ratio analysis.

The relationship between the product and reactant concentrations may thereby be constrained enough to allow for solving for reactant concentrations based on measured product concentrations and plasma parameters. These solutions may be determined directly, with sufficient product information, or may be solved iteratively or by machine learning applied to a body of data.

Returning to operations of FIG. 3 at block 319, the fluid loss or influx is estimated based on the concentration of species in the drilling mud. An influx of formation fluid into the wellbore or loss of drilling mud to the formation may be further determined based on the ratio of plasma reaction products. For example, with reference to FIG. 1, the information handling system 162 may perform this estimation. The information handling system 162 may determine a ratio between hydrogen and small molecular weight hydrocarbons or between hydrogen and aromatics or between small molecule alkanes and aromatics in order to estimate the amount of drilling fluid lost to the formation or the fluid volume gained due to an influx of formation fluids. The information handling system 162 may also estimate the total volume of drilling fluid returned to the surface using instrumentation 161 or fluid reconditioning system 142.

Drilling fluid or mud is necessary to maintain pressure downhole above the pore pressure of the formation. If the pressure downhole is below the pore pressure of the formation, the pressure downhole may be considered too low as gas and fluid may enter the wellbore from the surrounding formation. For reactive gases like $H_2$ and $H_2S$, entrance of dissolved gasses into the drilling mud may lead to corrosion downhole and may lead to violent or explosive evolution as the drilling mud moves towards lower pressures at the surface. If the pressure downhole is above the formation fraction pressure, the pressure downhole may be considered too high as the wellbore or wellbore walls may collapse as the formation is fractured or destroyed by drilling mud forces into weaker strata. Monitoring the amount or volume of drilling mud returned to the surface allows mud logging to estimate the influx of fluid into the wellbore or the loss of fluid to the formation. Pulse power drilling may complicate this determination because the chemical reactions downhole generate gaseous products, in addition to vaporization of water (from aqueous fluids) and carbon dioxide and the like dissolved in hydrocarbon fluids. Many of the gasses generated downhole via the plasma will dissolve, under pressure, back into the drilling fluid (which may be assumed to be a non-Newtonian high temperature and high-pressure fluid) as the plasma is quenched. The gaseous products are detectable via low pressure or low temperature gas extraction, or distillation, from the drilling fluids.

Further, influx and loss may be detected by a shift in the chemical composition of the drilling fluid, or product concentrations in the drilling fluid. When drilling fluid is lost to the formation, that loss may result in a steadier drilling fluid chemical composition. The drilling fluid returned to the surface may significantly match the composition of the drilling fluid that was pumped downhole. The loss to the formation limits the amount of hydroxyl free radicals created from water molecules available to catalyze the chemical reactions downhole, and therefore slows reaction rates.

In the case of an influx into the wellbore, formation fluid and product concentration in the drilling fluid may increase. Saltwater flow into the wellbore may significantly increase the amount of hydrogen gas detected at the surface. The ions present in the saltwater increase the fractional ionization of the plasma formed downhole. The increase in hydroxyl groups (where water readily decomposes into hydroxyl groups and hydrogen) may increase reaction rates, but significantly increases the production of hydrogen molecules at a rate greater than the increase for other products. An influx of gas from the formation increases the concentration of methane and short carbon products. Hydrocarbon gas is already heavy in small molecular weight carbon species (i.e. approximately $n \leq 10$), and these reactants tend to crack and form small unsaturated molecules or merge but remain small in the presence of catalyst. An influx of oil from the formation, where oils contain high molecular weight hydrocarbons, may lead to an increase in the complex, aromatic, and unsaturated product species and concentrations.

The total volume of drilling fluid or drilling fluid level in the mud pit remains a valuable method of measuring formation loss and influx. However, monitoring the products of the chemical reactions downhole enable mud logging to further record information about the formation fluid.

At block 320, the estimated formation fluid concentrations are refined by correlating reaction rates to plasma energy. Reaction rate calculations may be applied to generate additional equations to better define the system of linear equations to generate a definite solution. For example, with reference to FIG. 1, the information handling system 162 may perform this operation. Many of the reaction pathways may share transition states, where transition states determine the activation energy $E_a$ of a reaction pathway. For reactions with known activation energy, the reaction rate constant may be calculated directly from the measured temperature at the plasma (based on the Arrhenius or similar equation) or may be estimated based on a plasma power analysis performed in the wellbore previously.

Free radicals are high energy and unstable, especially in alkanes. The hydroxyl radical has the longest lifetime of the free radicals produced downhole. The chemical reactions occur at equilibrium in the plasma, where high velocity electrons enable formation of transition states. For photon-emitting plasmas, photons may generate excited states inside the plasma and in surrounding fluid. Without regard to which excitation mechanism generates the transition state, products are generated as the plasma is quenched and further chemical transitions become energetically unfavorable.

Further information is gained via periodic off bottom plasma generation events. The drilling bit is retracted from the wellbore bottom and suspending in the wellbore surrounded by drilling fluid (or only partially introduced into the well) and a plasma is generated, the contribution of the drilling fluid to the reaction rate and product species is then measured. The drilling fluid plasma products is then subtracted from the total product concentration measured at the surface, to selectively identify the reaction products corresponding to the formation and formation fluid at the wellbore bottom. The off bottom analysis may also be conducted for a variety of plasma powers, in order to determine the arc vs. spark ratio of each plasma power setting which may be extrapolated as the arc vs. spark ratio for the wellbore bottom plasma in the formation.

At block 322, an arc to spark ratio is calculated based on concentrations, gas species, and volume of the drilling mud. A ratio between the plasma power that generates the plasma arc and the plasma power that generates any plasma sparks is calculated. For example, with reference to FIG. 1, the information handling system 162 may make this calculation. This ratio may be calculated as a fraction, a percentage, or a range. The ratio between the arc and spark for the plasma may depend on the power used to generate the plasma and upon wellbore geometry and dielectric characteristics. As discussed in reference to FIG. 2A-2C (and further discussed in reference to FIGS. 4A-4B and 5A-5B below), both porosity and permeability along with formation fluid resistivity, may contribute both to the total dielectric strength between the anode and cathode and to the distribution of plasma arcing vs. sparking. Plasma arcs and plasma sparks may produce distinctive products and the ratio of these products may correspond to the ratio between the plasma arc and spark. For instance, plasma sparks generate high temperature, more spherical plasma and vapor bubbles in fluid. Whereas, plasma arcs generate lower temperature, more elongated bubbles with longer lifetimes. Certain species, for example are preferentially formed in each type of plasma. For example, plasma sparks favor formation of hydroxyl catalyzed reaction and produce a significant amount of hydrogen. Whereas, plasma arcs favor photon catalyzed reactions, where ultraviolet (UV) photons especially promote carbon-carbon bond formation especially cyclic alkanes (naphthenes).

Figure 5A:
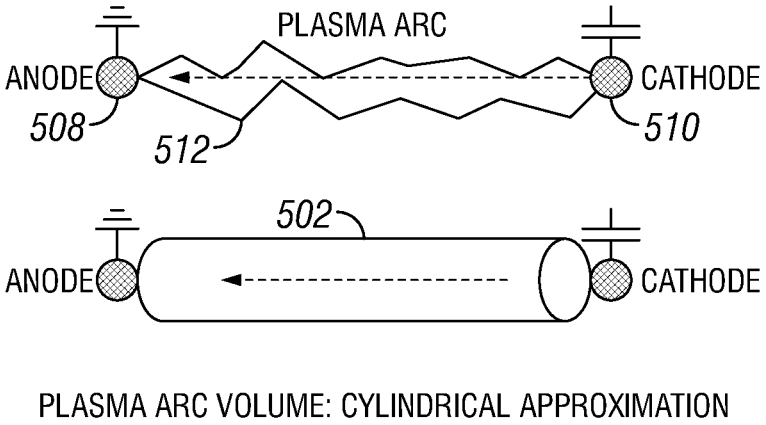
FIG. 5A depicts the geometric approximation for a plasma arc, according to one or more embodiments.
Figure 5B:
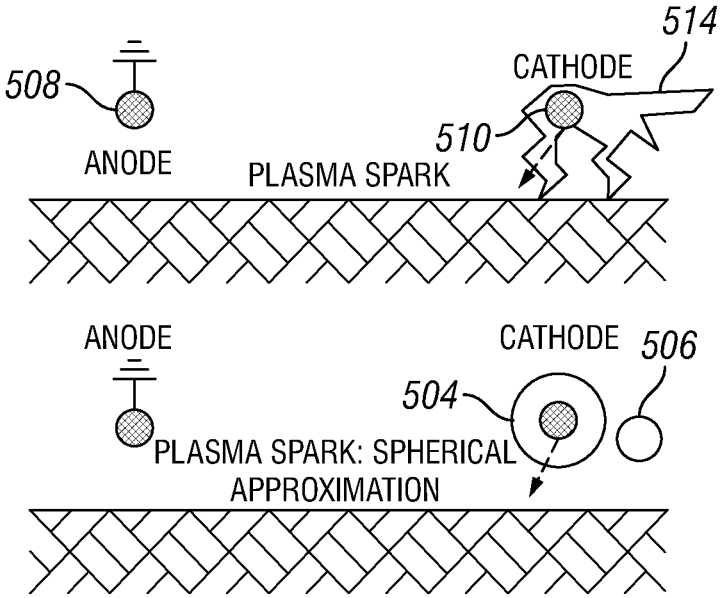
FIG. 5B depicts the geometric approximation for a plasma spark, according to one or more embodiments.

To help illustrate, FIGS. 5A-5B depict example geometric approximations for a plasm arc and a plasma spark, respectively. FIG. 5A depicts the geometric approximation for a plasma arc, according to one or more embodiments. FIG. 5A depicts a plasma arc 512 between an anode 508 and a cathode 510. The plasma arc 512 may be generated as DC plasma discharges, between the anode 508 and the cathode 510. As shown, the plasma arc 512 appears as jagged emissive paths as the DC plasma discharges. AC plasma discharges tend to have a softer more even glow and are usually contained by a magnetic field. The plasma arc 512 is visible because highly energetic electrons and molecules are created, which emit photons as they decay back to their ground states.

Within a plasma, particles may be so energetic that chemical bonds are in flux. The chemical composition of ions and molecules may be set when they leave the plasma, either because the plasma is quenched, or because their kinetic energy takes them outside of the plasma bounds. In either case, the chemical reactions may occur at the boundaries of the plasma where each species no longer experiences the excitation or collisions for it to reach a transitional state (as explained in reference to FIGS. 4A-4B above). The chemical reaction rates for formation of complex hydrocarbons from alkanes and naphthenes (as described in Equation 22) may depend most closely on the concentration of hydroxyl radicals and on energetic photons, both of which function as catalysts for such reactions. As depicted in FIG. 5A, the plasma arc 512 may be approximated as a cylinder 502 sustained by electrons from the anode 508 to the cathode 510 and generate larger, elongated gas-phase bubbles.

FIG. 5B depicts the geometric approximation for a plasma spark, according to one or more embodiments. FIG. 5B depicts a plasma spark 514 between the anode 508 and the cathode 510. The plasma spark 514 may be generated as a DC plasma discharges between the anode 508 and the cathode 510. As shown, the plasma spark 514 appears as a jagged branching path surrounding the cathode 510. The plasma spark 514 may represent the plasma generated that does not complete the circuit between the anode 508 and the cathode 510. Plasma spark 514 is visible because, as for the plasma arc, highly energetic electrons and molecules are created, which emit photons as they decay back to their ground states. The plasma spark 514 tends to generate spherical bubbles 504, 506 as a result of hydrodynamics.

Each type of plasma also trends towards a different plasma temperature. Plasma arcs have lower electron temperatures than plasma sparks, where plasma sparks have higher electron kinetic energy because more energy is required to create a plasma in the absence of the strong electric field between the anode and cathode. The individual reactions occurring in each type of plasma may be the same, but the dominant reaction mechanisms may differ as a result of differences in surface area and temperature.

With continued reference to block 322, during plasma drilling operations, drilling fluid 130 (e.g., referring to FIG. 1) may be formulated or modified to have one or more identified electrical properties in order to limit electrical discharge through drilling fluid 130. In electric discharge drilling, for example, a low frequency, high electric field may be applied to a targeted region of formation 208 (e.g., referring to FIG. 2), which may cause formation 208 to physically break down around the targeted region. To limit discharge of the electric field through drilling fluid 130 and allow more electrical current to flow into the targeted region of formation 208, an electrically insulating drilling fluid 130 with a high dielectric constant and a high dielectric strength at a particular operating frequency may be used. An electrically insulating drilling fluid 130 may restrict the movement of electrical charges, and therefore, the flow of electrical current through drilling fluid 130. A high dielectric constant and high dielectric strength may also decrease electrical discharge through drilling fluid 130. The dielectric constant of the downhole fluid may indicate the ability of the drilling fluid 130 to store electrical energy when exposed to an electric field, such as a voltage potential created by an electric discharge drilling system, while the dielectric strength of drilling fluid 130 may indicate a voltage level to which the drilling fluid 130 may be exposed before experiencing electrical breakdown, or a loss of its electrically insulating properties. The foundation fluid may be an electrically insulating fluid. The foundation fluid may include a single fluid or a combination of more than one fluid. The components of the foundation fluid may be synthetically produced or refined from naturally occurring materials with electrically insulating properties. Further, the components of the foundation fluid may be selected to withstand a range of temperatures and pressures typical within a wellbore. For example, non-aqueous, oil-based fluids may withstand higher temperatures and higher pressures before breaking down as compared to other aqueous fluids. As an example, the foundation fluid may be formed of compounds including branched-chain paraffins having between approximately 18 and 40 carbon atoms per molecule, diester oils, hydrocarbon liquids substantially immiscible with water, oleaginous fluids (e.g., esters, olefins, diesel oils, and mineral oils including n-paraffins, iso-paraffins, cyclic alkanes, and/or branched alkanes), low polynuclear aromatic oils with a mixture of branched and cyclic paraffins, asphaltic mineral oils, and/or asphaltic residual fuel oils, and combinations thereof.

One or more additives may be selected to add to the foundation fluid to form a composite fluid with different electrical properties than those of the foundation fluid. Additives may be selected such that, when combined with the foundation fluid, the addition of additives results in the formation of a composite fluid with a dielectric constant and/or dielectric strength approximately equal to a target value or within a target range. The target value or range may be different from the value or range of the dielectric constant and/or dielectric strength of the foundation fluid. For example, one or more additives may be selected such that, when added to the foundation fluid, the addition of the additives results in the formation of a composite fluid with a dielectric constant and/or dielectric strength greater than the dielectric constant and/or dielectric strength of the foundation fluid. Additionally, one or more additives may be selected such that, when added to the foundation fluid or composite fluid, the addition of the additives results in the formation of a composite fluid with a dielectric constant and/or dielectric strength less than the dielectric constant and/or dielectric strength of the foundation fluid. Drilling fluid 130 and drill bit 123 may be optimized during drilling operations based on properties of formation 208.

Figure 6:
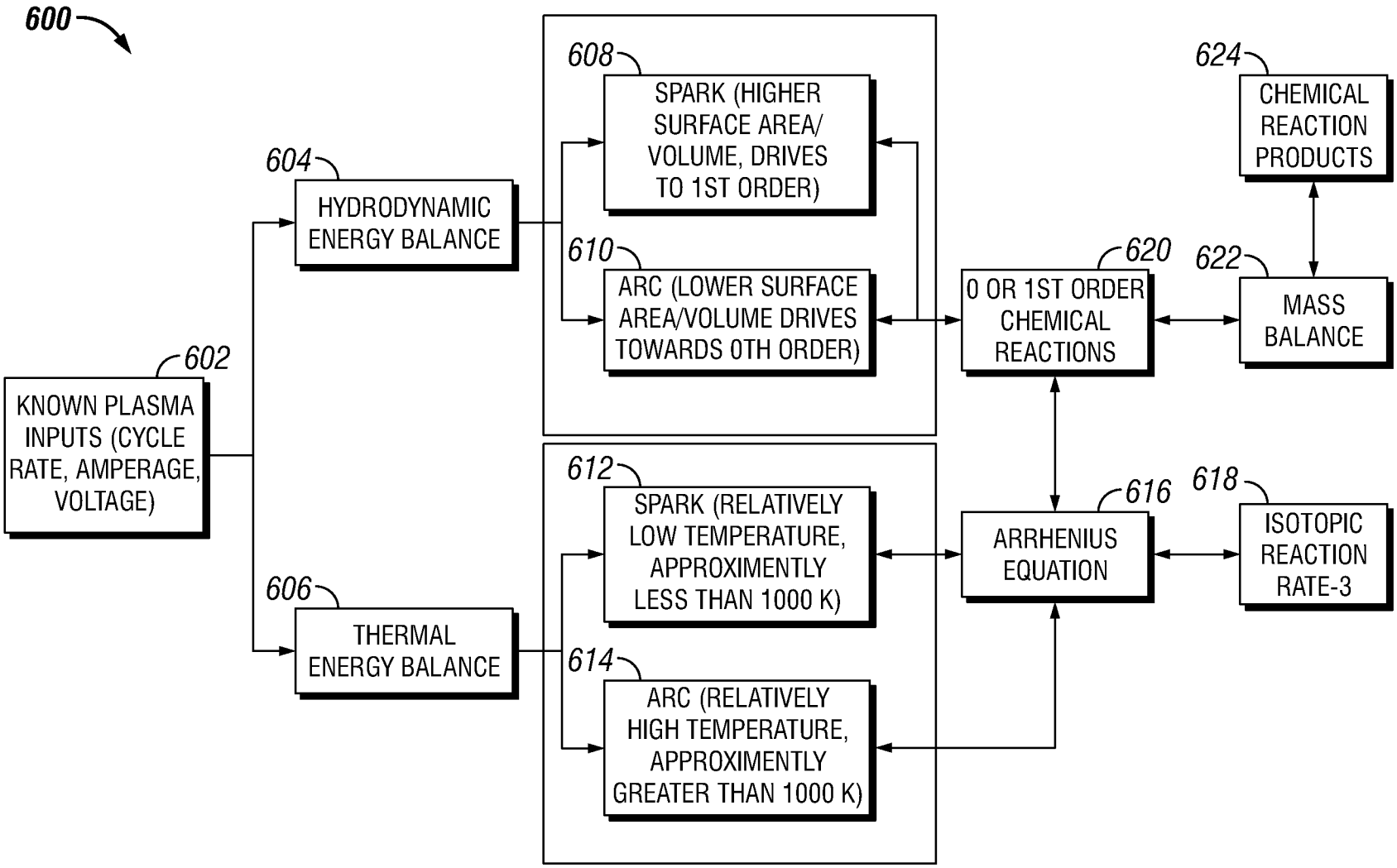
FIG. 6. is a workflow for drilling operations.

FIG. 6 is a workflow 600 for drilling operations. During drilling operations, information handling system 162 is connected to drill bit 123. In block 602, known plasma inputs are monitored. In examples, plasma inputs may be cycle rate, amperage, and/or voltage. Thus, as drill bit 123 operates and function, sensors (not illustrated) within drill bit 123 may monitor plasma energy output based on the measurements of cycle rate, amperage, or voltage. Additionally, other monitoring operations may include downhole fluid analysis or coring. These may be performed with a device on the drilling system or with a wireline operation. These samples are unadulterated by the drilling process and provide the clearest look of the makeup of formations and reservoir fluids. The sample may analyze hydrogen, carbon dioxide, saturated hydrocarbons, unsaturated hydrocarbons that are downhole. Additionally, the logging operations may determine pressure and temperature downhole.

The measured inputs from block 602 may be used for block 604 and block 606. Blocks 604 and 606 may be used to determine arc and spark. In examples, arc and spark may be formed as an energy ratio. Specifically, block 604 may be used to determine hydrodynamic energy balance and block 606 may be used to determine thermal energy balance. In both block 604 and 606, information handling system 162 may utilize the information from block 602 or other forms of analytical equipment to provide compositions to determine a generalized reaction scheme, which is illustrated below, used as basis of model:

$$A\cdot C_nH_{2n+2}+B\cdot C_nH_{2n}+C\cdot C_nH_{2n-2}+D\cdot CO_2+E\cdot O_2+F\cdot H_2\rightarrow G\cdot C_nH_{2n+2}+F\cdot H_2O \tag{48}$$

Application of specific a zero and/or a first order reaction kinetics to chemical species of concern to solve generalized reaction schemes using Equation (48). For example, block 604 may include using Equation (48) to determine spark in block 608 and arc in block 610 for drill bit 123. The spark favors $H_2$ and unsaturated products and arc favors carbon dioxide and hydroxyls. In block 604, hydrodynamic energy may be model to determine the production of chemical species, discussed below in block 624. Changing chemical species may alter the hydrodynamic energy in block 604, which may change the size of bubble, temperature, and spark or arc for drill bit 123. In the hydrodynamic energy balance, the volume and surface area of bubbles may be calculated. A perfect ratio equivalent to a sphere may closely resemble an arc for drill bit 123. A constrained path may be used as boundary conditions to estimate porosity and permeability of the formation. Both the porosity and permeability may be utilized as variable in Equation (48). For example, in block 608, to determine spark, higher surface area over volume dives Equation (48) to a first order reaction. In block 610, to determine arc, a lower surface area over volume drives Equation (48) to a zero-order reaction.

Referring back to block 606, thermal energy balance may include block 612 and block 614. In block 612, spark may be formed from a temperate equal to or less than 1000K. In block 614, arc may be formed from temperature greater than 1000K. The spark from block 612 and the arc from block 614 are combined in an Arrhenius Equation in block 616, shown below:

$$k = Ae^{\frac{-E_a}{RT}} \tag{49}$$

where k is a rate constant, A is the pre-exponential factor, $E_a$ is the activation energy, R is the universal gas constant, and Tis the absolute temperature.

From the Arrhenius Equation in block 616, an isotopic reaction rate is determined in block 618. The isotopic reaction rate may be expressed as a ratio. For example. The reaction rate $C_{12}$ to $C_{13}$ is expressed as:

$$\sqrt{\frac{13}{12}} \tag{50}$$

which is solved as 1.04. Two sets of reaction rates may be used and related through the ratio to determine original reaction rate. In examples, when taking into account a formation, the constants in the Arrhenius Equation in block 616 may change to account for catalytic effect of the formation.

Referring to block 616, the Arrhenius Equation may identify a zero or first order chemical reaction in block 620. Additionally, in block 620, a zero or first order chemical reaction may be identified from the combination of block 608 and 610, discussed above.

From block 620, a mass balance if found in block 622, which will lead to the determination of chemical reaction products in block 624. Specifically, block 622 may calculate original hydrocarbon concentrations in moles or mass using cycle rate, amperage, and voltage in block 602. This may allow for chemical reaction products in block 624 to be determined based on Equation (48). Additionally, during block 622, gas may be applied during drilling operations to identify fluid type. As the fluid changes, the concentrations on the left-hand side of the reaction, i.e., Equation (48), will change.

During workflow 600, Equation (48) may not be solved based on the inputs form block 602 and the chemical reaction products in block 624. To remedy this situation, the chemical reaction products in block 624 may be altered based on the cycle rate, amperage, and voltage in block 602 to balance out Equation (48) and solve for the chemical reaction products in block 624. Thus, personnel may alter the cycle rate, amperage, and voltage in block 602 to alter the final chemical reaction products in block 624. By monitoring the final chemical reaction products in block 624 and adjusting cycle rate, amperage, and voltage in block 602 allows for personnel to solve Equation (48). Solving for Equation (48) allows for personnel to determine the cycle rate, amperage, and voltage in block 602 and the final chemical reaction products in block 624. Additionally, by determining the properties in blocks 604 and 606 may also help in determining in Equation (48). It should be noted that power loss to the formation may be found in block 616, as discussed above. Specifically, power loss to the formation may be determined by block 606. For example, power loss may be due to formational electrical properties such as a dielectric constants, resistivity, and other parameters of the formation. In examples, a higher resistive formation may have less power loss to the formation as the dielectric constants play into the resistivity.

During operations, workflow 600 may be performed on a first wellbore to form a model that is stored on information handling system 162. The model is specific to modeling of the energy balance based on the conservation of change and plasma conductivity, as described in Equation (48). During operations in the first wellbore, the information obtained may be used on a second wellbore taking into account changes in power or another variable from the first wellbore utilizing workflow 600.

Returning to FIG. 3 at block 326, the plasma energy and reaction rate estimates and calculations are updated based on the arc to spark ratio from block 324, using workflow 600. For example, with reference to FIG. 1, the information handling system 162 may perform this update. The arc to spark ratio may estimate and updated, along with the other reaction and plasma parameters, until the stoichiometric equations balance and concentrations of formation fluid species are determined as discussed above in block 324. The information handling system 162 may determine the reactant concentrations exactly or to within a preselected error range. Such a determination may involve an iteration of all factors, multiple iterations, look up of reaction rate constants based on plasma power, or based on machine learning. The information handling system 162 may maintain a record of the drilling mud species concentration before and after the plasma is applied (i.e. before the mud is pumped downhole and then at the surface) in order to correctly account for species in the drilling fluid, species in the formation fluid, and the species that are reactants in the plasma chemical reaction (measured as chemical products).

that embody aspects of the disclosure. However, it is understood that this disclosure may be practiced without these specific details. For instance, this disclosure refers to pulsed direct current (DC) plasma in illustrative examples. Aspects of this disclosure may be also applied to sustained or alternating current (AC) plasmas. Additionally, while analysis may be described in reference to being performed at the surface of the borehole, example embodiments may include at least a partial analysis downhole. For example, some or all of the analysis may be performed in a downhole tool of the drill string. In other instances, well-known instruction instances, protocols, structures, and techniques have not been shown in detail in order not to obfuscate the description.

The methods and systems described above are an improvement of current art in that the drilling mechanism is a plasma bit. Additionally, the methods described optimize the plasma bit continuously during drilling. Thus, no matter the formation the plasma bit may encounter, the plasma bit may change electrical properties of the plasma bit to cut through the formation while efficiently using the energy provided. The methods and apparatus may include any of the various features disclosed herein, including one or more of the following statements.

Statement 1: A method for drilling may comprise disposing a bottom hole assembly into a first wellbore. The bottom hole assembly may comprise a pulse power drilling assembly having one or more electrodes disposed on a drill bit and a pulse-generating circuit. The method may further comprise activating the one or more electrodes by applying an amperage, a voltage, and a cycle rate to the one or more electrodes to form an arc and a spark, adjusting the arc and the spark based at least in part on a hydrodynamic energy balance and a thermal energy balance, identifying one or more chemical reaction products created from an interaction of the arc and the spark with a formation, and adjusting the amperage, the voltage, and the cycle rate based on the chemical reaction products and storing the adjusted amperage, voltage, and cycle rate.

Statement 2: The method of statement 1, wherein the spark in the hydrodynamic energy balance produces a first order reaction.

Statement 3. The method of statements 1 or 2, wherein the arc in the thermal energy balance produces a zero-order reaction.

Statement 4. The method of statement 1, wherein the spark in the thermal energy balance is produced at a low temperature.

Statement 5. The method of statements 1 or 4, wherein the arc in the thermal energy balance is produced at a high temperature.

Statement 6. The method of statement 1, wherein identifying one or more chemical reaction products is found from a mass balance by calculating hydrocarbon concentrations in moles or mass using the amperage, the voltage, and the cycle rate.

Statement 7. The method of statements 1 or 6, further comprising applying a gas to identify a fluid for the hydrocarbon concentrations.

Statement 8. The method of statement 1, further comprising determining an isotopic reaction rate by forming a ratio from two hydrocarbon reaction rates.

Statement 9. The method of statements 1 or 8, wherein the ratio determines the isotropic reaction rate of the formation to the arc and the spark.

Statement 10. The method of statement 1, further comprising disposing the bottom hole assembly into a second wellbore and using the adjusted amperage, the adjusted voltage, and the adjusted cycle rate for drilling operations.

Statement 11. A system for drilling may comprise a bottom hole assembly and an information handing system. The bottom hole assembly may comprise a pulse power drilling assembly having one or more electrodes disposed on a drill bit and a pulse-generating circuit. The information handling system may be connected to the bottom hole assembly. The bottom hole assembly is configured to activate the one or more electrodes by applying an amperage, a voltage, and a cycle rate to the one or more electrodes to form an arc and a spark, adjust the arc and the spark based at least in part on a hydrodynamic energy balance and a thermal energy balance, identify one or more chemical reaction products created from an interaction of the arc and the spark with a formation, and adjust the amperage, the voltage, and the cycle rate based on the chemical reaction products and storing the adjusted amperage, voltage, and cycle rate.

Statement 12. The system of statement 11, wherein the spark in the hydrodynamic energy balance produces a first order reaction.

Statement 13. The system of statements 11 or 12, wherein the arc in the thermal energy balance produces a zero-order reaction.

Statement 14. The system of statement 11, wherein the spark in the thermal energy balance is produced at a low temperature.

Statement 15. The system of statements 11 or 14, wherein the arc in the thermal energy balance is produced at a high temperature.

Statement 16. The system of statement 11, wherein the identify one or more chemical reaction products is found from a mass balance by calculating hydrocarbon concentrations in moles or mass using the amperage, the voltage, and the cycle rate.

Statement 17. The system of statement 11 or 16, wherein the information handling system is further configured to apply a gas to identify a fluid for the hydrocarbon concentrations.

Statement 18. The system of statement 11, wherein the information handling system is further configured to determine an isotopic reaction rate by forming a ratio from two hydrocarbon reaction rates.

Statement 19. The system of statements 11 or 18, wherein the ratio determines the isotropic reaction rate of the formation to the arc and the spark.

Statement 20. The system of statement 11, wherein the information handling system is further configured to use the adjusted amperage, the adjusted voltage, and the adjusted cycle rate for a second drilling operation.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method for drilling comprising:

disposing a bottom hole assembly into a first wellbore, wherein the bottom hole assembly comprises:

a pulse power drilling assembly having one or more electrodes disposed on a drill bit; and a pulse-generating circuit; and activating the one or more electrodes by applying an amperage, a voltage, and a cycle rate to the one or more electrodes to form an arc and a spark;

adjusting the arc and the spark based at least in part on a hydrodynamic energy balance and a thermal energy balance;

identifying one or more chemical reaction products created from an interaction of the arc and the spark with a formation; and adjusting the amperage, the voltage, and the cycle rate based on the chemical reaction products and storing the adjusted amperage, voltage, and cycle rate.

2. The method of claim 1, wherein the spark in the hydrodynamic energy balance produces a first order reaction.

3. The method of claim 2, wherein the arc in the thermal energy balance produces a zero-order reaction.

4. The method of claim 1, wherein the spark in the thermal energy balance is produced at a low temperature.

5. The method of claim 4, wherein the arc in the thermal energy balance is produced at a high temperature.

6. The method of claim 1, wherein identifying one or more chemical reaction products is found from a mass balance by calculating hydrocarbon concentrations in moles or mass using the amperage, the voltage, and the cycle rate.

7. The method of claim 6, further comprising applying a gas to identify a fluid for the hydrocarbon concentrations.

8. The method of claim 1, further comprising determining an isotopic reaction rate by forming a ratio from two hydrocarbon reaction rates.

9. The method of claim 8, wherein the ratio determines the isotropic reaction rate of the formation to the arc and the spark.

10. The method of claim 1, further comprising disposing the bottom hole assembly into a second wellbore and using the adjusted amperage, the adjusted voltage, and the adjusted cycle rate for drilling operations.

11. A system for drilling comprising:

a bottom hole assembly comprising:

a pulse power drilling assembly having one or more electrodes disposed on a drill bit; and a pulse-generating circuit; and an information handling system connected to the bottom hole assembly, wherein the bottom hole assembly is configured to:

activate the one or more electrodes by applying an amperage, a voltage, and a cycle rate to the one or more electrodes to form an arc and a spark;

adjust the arc and the spark based at least in part on a hydrodynamic energy balance and a thermal energy balance;

identify one or more chemical reaction products created from an interaction of the arc and the spark with a formation; and adjust the amperage, the voltage, and the cycle rate based on the chemical reaction products and storing the adjusted amperage, voltage, and cycle rate.

12. The system of claim 11, wherein the spark in the hydrodynamic energy balance produces a first order reaction.

13. The system of claim 12, wherein the arc in the thermal energy balance produces a zero-order reaction.

14. The system of claim 11, wherein the spark in the thermal energy balance is produced at a low temperature.

15. The system of claim 14, wherein the arc in the thermal energy balance is produced at a high temperature.

16. The system of claim 11, wherein the identify one or more chemical reaction products is found from a mass balance by calculating hydrocarbon concentrations in moles or mass using the amperage, the voltage, and the cycle rate.

17. The system of claim 16, wherein the information handling system is further configured to apply a gas to identify a fluid for the hydrocarbon concentrations.

18. The system of claim 11, wherein the information handling system is further configured to determine an isotopic reaction rate by forming a ratio from two hydrocarbon reaction rates.

19. The system of claim 18, wherein the ratio determines the isotropic reaction rate of the formation to the arc and the spark.

20. The system of claim 11, wherein the information handling system is further configured to use the adjusted amperage, the adjusted voltage, and the adjusted cycle rate for a second drilling operation.

* * * * *